US008652733B2

(12) United States Patent
Yamasaki et al.

(10) Patent No.: US 8,652,733 B2
(45) Date of Patent: Feb. 18, 2014

(54) ELECTROSTATIC IMAGE DEVELOPING TONER, ELECTROSTATIC IMAGE DEVELOPER, IMAGE FORMING METHOD, TONER CARTRIDGE, PROCESS CARTRIDGE, AND IMAGE FORMING APPARATUS

(75) Inventors: Sumiaki Yamasaki, Kanagawa (JP); Kazuhiko Yanagida, Kanagawa (JP); Susumu Yoshino, Kanagawa (JP); Satoshi Hiraoka, Kanagawa (JP); Shigeru Seitoku, Kanagawa (JP); Hirofumi Shiozaki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 311 days.

(21) Appl. No.: 13/024,020

(22) Filed: Feb. 9, 2011

(65) Prior Publication Data

US 2012/0052430 A1 Mar. 1, 2012

(30) Foreign Application Priority Data

Aug. 25, 2010 (JP) ..... 2010-188883

(51) Int. Cl.
*G03G 9/093* (2006.01)

(52) U.S. Cl.
USPC ..... 430/110.2; 430/137.11

(58) Field of Classification Search
USPC ..... 430/110.2, 137.11, 108.4, 137.14; 399/252, 119
See application file for complete search history.

(56) References Cited

U.S. PATENT DOCUMENTS

| | | | | |
|---|---|---|---|---|
| 4,623,605 | A | 11/1986 | Kato et al. | |
| 5,858,598 | A | 1/1999 | Nakayama | |
| 6,686,110 | B2 | 2/2004 | Kadota | |
| 7,018,762 | B2 | 3/2006 | Kadota | |
| 7,507,516 | B2 * | 3/2009 | Hayashi et al. | 430/137.11 |

FOREIGN PATENT DOCUMENTS

| | | |
|---|---|---|
| JP | B2-4-75500 | 9/1984 |
| JP | A-2-45188 | 2/1990 |
| JP | A-2-289859 | 11/1990 |
| JP | A-5-119518 | 5/1993 |
| JP | A-7-199519 | 8/1995 |
| JP | A-11-84726 | 3/1999 |
| JP | A-2002-91064 | 3/2002 |

OTHER PUBLICATIONS

Diamond, A.S. ed., et al., Handbook of Imaging Materials, second edition, Marcel Dekker, Inc., NY (2002), pp. 146-148.*

* cited by examiner

*Primary Examiner* — Janis L Dote
(74) *Attorney, Agent, or Firm* — Oliff, PLC

(57) ABSTRACT

An electrostatic image developing toner includes a core particle containing a binder resin and a coating layer on the core particle. The coating layer contains a resin having a crosslinked structure formed by using at least one of boric acid and derivatives thereof, and the resin having the crosslinked structure is obtained by polymerizing monomers in the presence of the core particle.

11 Claims, 2 Drawing Sheets

ELECTROSTATIC IMAGE DEVELOPING TONER, ELECTROSTATIC IMAGE DEVELOPER, IMAGE FORMING METHOD, TONER CARTRIDGE, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2010-188883 filed Aug. 25, 2010.

BACKGROUND

Technical Field

The present invention relates to an electrostatic image developing toner, an electrostatic image developer, an image forming method, a toner cartridge, a process cartridge, and an image forming apparatus.

SUMMARY

According to an aspect of the invention, there is provided an electrostatic image developing toner that includes a core particle containing a binder resin and a coating layer on the core particle. The coating layer contains a resin having a crosslinked structure formed by using at least one of boric acid and derivatives thereof, and the resin having the crosslinked structure is obtained by polymerizing monomers in the presence of the core particle.

BRIEF DESCRIPTION OF THE DRAWINGS

Exemplary embodiments of the present invention will be described in detail based on the following figures, wherein.

DETAILED DESCRIPTION

Figure 1:
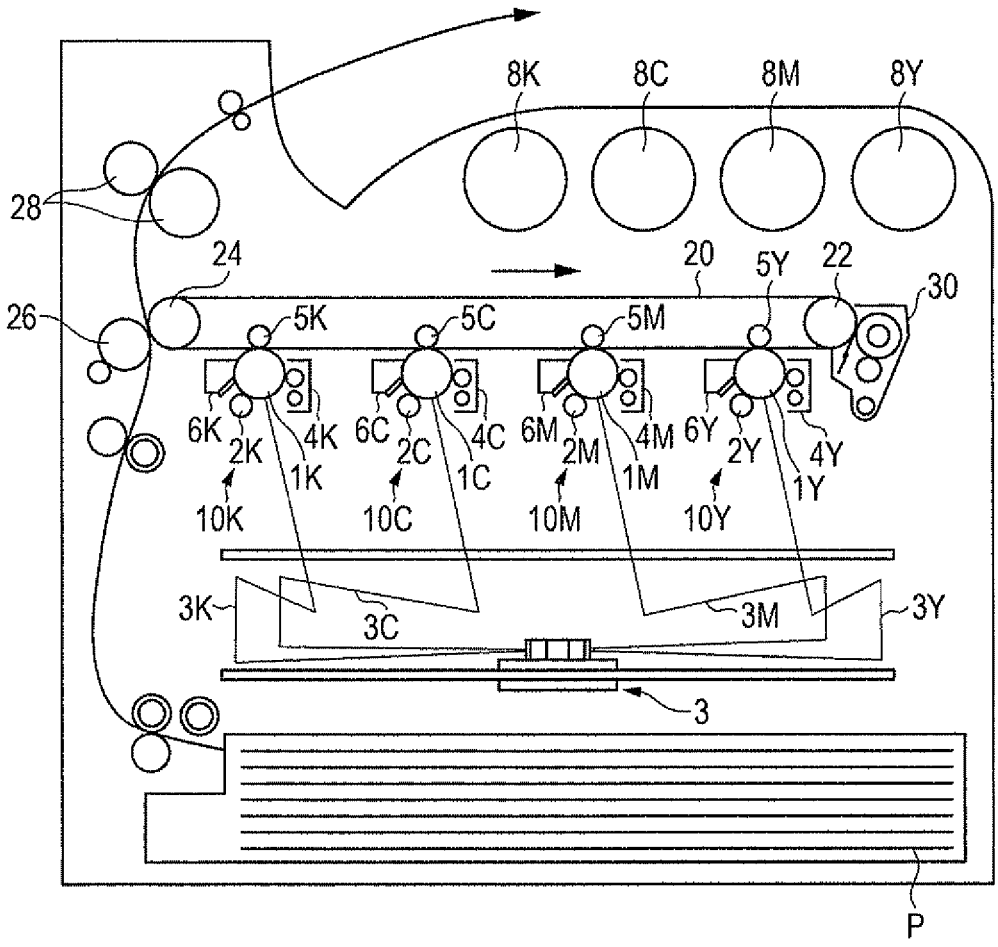
FIG. 1 is a schematic diagram showing one example of an image forming apparatus according to an exemplary embodiment.

Exemplary embodiments of an electrostatic image developing toner, an electrostatic image developer, an image-forming method, a toner cartridge, a process cartridge, and an image forming apparatus will now be described in detail.

[Electrostatic Image Developing Toner]

An electrostatic image developing toner (also referred to as "toner" hereinafter) according to an exemplary embodiment includes a toner particle that includes a core particle containing a binder resin and a coating layer containing a resin (also referred to as "boron crosslinked resin" hereinafter) having a crosslinked structure derived from at least one of boric acid and boric acid derivatives (also referred to as "boric acid or the like" hereinafter). The coating layer is formed on the surface of the core particle by polymerizing monomers on the surface of the core particle.

The boron crosslinked resin is a resin having a crosslinked structure (structure in which two or more functional groups in a polymer compound are bonded to each other through boron atoms) resulting from reactions between boric acid or the like and two or more functional groups (groups reactive to boric acid or the like) contained in a polymer compound. To be more specific, in the case where boric acid is reacted with two OH groups (group reactive to boric acid or the like) in a polymer compound, a crosslinked structure having a —O—B—O— structure is formed as a result of dehydration reaction, and the —O—B—O— structure is regarded as functioning as a link that bonds the two OH groups to each other. In other words, in a boron crosslinked resin, the boron atoms contribute to formation of the crosslinked structure. Hereinafter, the crosslinked structure formed by contribution of a boron atom may be referred to as "boron crosslinked structure" or a "boric acid ester crosslinked structure.

The two or more functional groups (groups reactive to boric acid or the like) in the polymer compound may be contained in one molecule or two or more different molecules. In other words, two or more sites in one molecule of the polymer compound may be linked with each other through a boron atom, or different molecules of the polymer compound may be linked with each other through a boron atom.

Since the toner includes a coating layer containing a boron crosslinked resin and being formed by polymerizing monomers on the surface of the core particle, fogging caused by an increase in toner amount in a developing device is suppressed.

In particular, some image forming apparatuses are set to form images at a lower toner density and with less toner stirred in a developing device to compensate for the deterioration of toner particle charging performance in a high-temperature, high-humidity (e.g., 30° C. and 85% RH) environment compared to a low-temperature, low-humidity (e.g., 10° C. and 30% RH) environment. With image forming apparatuses having the above-described settings, the amount of toner stirred in a developing device increases rapidly when the environment is changed from a high-temperature, high-humidity environment to a low-temperature, low-humidity environment. However, as long as the toner of this exemplary embodiment is used, fogging is suppressed despite the rapid increase in the toner amount in the developing device. Although the exact reason therefor is not clear, the following may be presumed.

That is, the toner of the exemplary embodiment includes toner particles having coating layers containing a boron crosslinked resin. Thus, compared to when the resin in the coating layers does not have a crosslinked structure, the hardness of the coating layer is high. Presumably since the coating layer is formed by polymerizing monomers on the surface of a core particle, the boron crosslinked resin thoroughly coats the entire surface of the core particle while achieving a molecular-level uniformity and more even distribution. Accordingly, in this exemplary embodiment, the toner particle has higher strength and not easily broken under a pressure caused by stirring in the developing device compared to when the coating layer contains no boron crosslinked resin or when the coating layer is not formed by polymerizing monomers on the surface of the core particle.

When the toner of the exemplary embodiment is used, the toner particles are not easily breakable even when the amount of toner stirred in the developing device is small and the stress applied to individual toner particles continues to be large. Thus, it is presumed that the fragments of the broken toner particles are suppressed from being accumulated in the developing device. When the fragments of toner particles broken under stress are accumulated in the developing device, the toner charging performance of the developing device is lowered. Thus, when the amount of toner in the developing device increases rapidly as described above, operation of charging the toner particles may not catch up with such a rapid increase and fogging may occur due to the presence of less-charged toner particles. However, according to this exemplary embodiment, the toner particles are resistant to breaking even when the amount of toner in the developing device is small and accumulation of toner particle fragments is suppressed. Thus, fogging caused by the increase in the toner amount is presumably suppressed.

The toner of the exemplary embodiment including the coating layer containing a boron crosslinked resin has a low minimum fixing temperature and thus exhibits good fixability compared to when the coating layer contains a crosslinked resin other than the boron crosslinked resin. The reason therefor is not clear but is probably the dissociation of the boron crosslinked structure caused by heat (temperature of 100° C. to 160° C., for example) applied to the boron crosslinked resin during fixing. Compared to when a crosslinked resin other than the boron crosslinked resin is used, presumably, the hardness of the resin at the fixing temperature is low and thus the minimum fixing temperature is low. When the boron crosslinked resin is cooled (e.g., cooled to a temperature of 90° C. or lower) after being heated to the fixing temperature, the dissociated crosslinked structure is recombined. Thus, the strength of the fixed image is increased and the fixability is improved.

As described above, the boron crosslinked resin is contained in the coating layer and not necessarily in the core particle. Alternatively, the boron crosslinked resin may be contained in the core particle. When the binder resin in the core particle does not have a crosslinked structure, the toner particle interior is soft and the coating layer is hard compared to when the core particle contains a boron crosslinked resin. Thus, the toner particles do not easily break under pressure applied during stirring in the developing device and the minimum fixing temperature is low. For this reason, the core particle may contain neither boron crosslinked resin nor other resins having crosslinked structures.

Since the toner of the exemplary embodiment has the above-described structure, fogging caused by the increase in toner amount is suppressed even when the toner is used to form an image at an image-forming speed of 500 mm/sec. The term "image-forming speed" refers to a speed at which an image is formed in an image forming apparatus and is equivalent to, for example, the speed at which a receiving member is transported. In other words, when an image is formed at a high image-forming speed, the receiving member is transported at a high speed, the speed of rotation of an image-carrying member is also high, and the speed of stirring in the developing device is also high. When the speed of stirring is high, the stress applied to the toner particles in the developing device is increased.

In this exemplary embodiment, the toner particles do not easily break even when the stress is large. Fogging caused by the increase in toner amount is thus suppressed even at the aforementioned image-forming speed.

The material, process conditions, and evaluation and analytic conditions employed in the exemplary embodiment will now be described in detail.

The toner of the exemplary embodiment may include an external additive in addition to the toner particle including the core particle and the coating layer. First, the coating layer of the toner particle is described.

<Coating Layer>

The coating layer contains a boron crosslinked resin and may contain other components such as another resin, if needed. The boron crosslinked resin is a resin having a boric acid ester crosslinked structure resulting from reactions between boric acid or the like and two or more functional groups (groups reactive to boric acid or the like) contained in a polymer compound.

—Boric Acid and Boric Acid Derivatives—

Examples of the boric acid and derivatives thereof include unsubstituted boric acid and boric acid derivatives such as organic boric acid, boric acid salts, and boric acid esters.

Examples of the organic boric acids include n-butyl boric acid, 2-methylpropyl boric acid, phenyl boric acid, o-tolyl boric acid, p-tolyl boric acid, and 4-methoxyphenyl boric acid.

Examples of the boric acid salts include inorganic boric acid salts and organic boric acid salts, e.g., sodium tetraborate and ammonium borate.

Examples of the boric acid esters include trimethyl borate, triethyl borate, tri-n-propyl borate, tri-i-propyl borate, tri-n-butyl borate, tri-tert-butyl borate, triphenyl borate, di-i-propyl butyl borate, trihexyl borate, tri(2-ethylhexyl) borate, trioctadecyl borate, tritetradecyl borate, and triphenyl borate. The boric acid esters may have a cyclic structure. Examples of the cyclic boric acid esters include 2,4,6-trimethoxyboroxin and 2,4,6-trimethylboroxin. These compounds may be anhydrous or hydrated but are preferably anhydrous. Among the boric acid and its derivatives, boric acid, trimethyl borate, triethyl borate, tri-i-propyl borate, tri-n-butyl borate, and tri (2-ethylhexyl) borate are preferred.

—Polymer Compound Having Groups Reactive to Boric Acid or the Like—

Examples of the polymer compound that forms a boron crosslinked resin when reacted with boric acid or the like include polymer compounds having groups reactive to boric acid or the like (may be referred to as "boric acid-reactive group" hereinafter). An example of the boric acid-reactive group is an OH group. Examples of the polymer compound having the boric acid-reactive group include polymer compounds that contain constitutional units derived from the monomers having the boric acid-reactive group. The polymer compound may contain constitutional units derived from other monomers in addition to the constitutional unit derived from the monomer having the boric acid-reactive group. In other words, the polymer compound may be a homopolymer made from a monomer having a boric acid-reactive group or a copolymer of the monomer having the boric acid-reactive group and another monomer.

The polymer compound having the boric acid-reactive group may be obtained by polymerizing a monomer having the boric acid-reactive group, copolymerizing the monomer having the boric acid-reactive group and another monomer, introducing a boric acid-reactive group into a polymer compound having no boric acid-reactive group, or introducing another boric acid-reactive group into the polymer compound having a boric acid-reactive group.

When the polymer compound having the boric acid-reactive group is a copolymer of a monomer having a boric acid-reactive group and another monomer, the ratio of the constitutional units derived from the monomer having the boric acid-reactive group to all constitutional units derived from the monomer having the boric acid-reactive group and the other monomer is, for example, 5 mass % to 70 mass % and may be 10 mass % to 30 mass %.

The polymer compound may be of any type as long as the boric acid-reactive group is contained. Examples thereof include acrylic resins such as (meth)acrylic acid, styrene-(meth)acrylic copolymers, and styrene-alkyl (meth)acrylate copolymers; and modified acrylic resins. The phrase "(meth) acryl" includes both "acryl" and "methacryl" and is used in this sense in the description below.

Acrylic resins having OH groups will now be described as an example of the polymer compound.

Examples of the monomer including an OH group include 2-hydroxyethyl (meth)acrylate, 2-hydroxypropyl (meth) acrylate, 2-hydroxypentyl (meth)acrylate, phenoxyhydroxypropyl (meth)acrylate, hydroxyphenyl (meth)acrylate, hydroxybenzyl (meth)acrylate, glycerol (meth)acrylate, dihydroxyphenethyl (meth)acrylate, trimethylolpropane mono(meth)acrylate, pentaerythritol mono(meth)acrylate, 2-(hydroxyphenylcarbonyloxy)ethyl (meth)acrylate, caprolactone-modified 2-hydroxyethyl (meth)acrylate, polyethylene glycol mono(meth)acrylate, and polypropylene glycol mono(meth)acrylate. Among these, glycerol acrylate, glycerol methacrylate, 2-hydroxyethyl acrylate, 2-hydroxyethyl methacrylate, 2-hydroxypropyl acrylate, and 2-hydroxypropyl methacrylate are particularly preferable. These monomers may be used alone or in combination.

Examples of the other monomer include (meth)acrylic acid esters, (meth)acrylamides, vinyl esters, styrenes, (meth) acrylic acids, (meth) acrylonitrile, maleic anhydrides, and maleic acid imides.

Examples of the (meth)acrylic acid esters include methyl (meth)acrylate, ethyl (meth)acrylate, (n-, i-, sec-, or tent-) butyl (meth)acrylate, amyl (meth)acrylate, 2-ethylhexyl (meth)acrylate, dodecyl (meth)acrylate, stearyl (meth)acrylate, chloroethyl (meth)acrylate, cyclohexyl (meth)acrylate, isobornyl (meth)acrylate, dicyclopentanyl (meth)acrylate, allyl (meth)acrylate, benzyl (meth)acrylate, methoxy benzyl (meth)acrylate, chlorobenzyl (meth)acrylate, furfuryl (meth) acrylate, tetrahydrofurfuryl (meth)acrylate, phenyl (meth) acrylate, chlorophenyl (meth)acrylate, and sulfamoylphenyl (meth)acrylate.

Examples of the (meth)acrylamides include (meth)acrylamide, N-methyl (meth)acrylamide, N-ethyl (meth) acrylamide, N-propyl (meth) acrylamide, N-butyl (meth) acrylamide, N-benzyl (meth) acrylamide, N-phenyl (meth) acrylamide, N-tolyl (meth)acrylamide, N-(sulfamoylphenyl) (meth)acrylamide, N-(phenylsulfonyl) (meth)acrylamide, N-(tolylsulfonyl) (meth)acrylamide, N,N-dimethyl (meth) acrylamide, and N-methyl-N-phenyl (meth) acrylamide.

Examples of the vinyl esters include vinyl acetate, vinyl butyrate, and vinyl benzoate.

Examples of the styrenes include styrene, methylstyrene, dimethylstyrene, tirmethylstyrene, ethylstyrene, propylstyrene, cyclohexylstyrene, chloromethylstyrene, trifluoromethylstyrene, ethoxymethylstyrene, acetoxymethylstyrene, methoxystyrene, dimethoxystyrene, chlorostyrene, dichlorostyrene, bromostyrene, iodostyrene, fluorostyrene, and carboxystyrene.

The other monomer is particularly preferably a (meth) acrylic acid ester. Among the (meth)acrylic acid esters, methyl (meth)acrylate, (n-, i-, sec-, or tert-)butyl (meth)acrylate, cyclohexyl (meth)acrylate, benzyl (meth)acrylate, isobornyl (meth)acrylate, and dicyclopentanyl (meth)acrylate are particularly preferable.

The modified acrylic resins may be obtained by block copolymerization, graft copolymerization, etc.

<Core Particle>

The core particle at least contains a binder resin and may contain other components such as a colorant, a releasing agent, a charge control agent, and inorganic oxide particles.

—Binder Resin—

Examples of the binder resin include homopolymers and copolymers, e.g., monoolefins such as ethylene, propylene, and isoprene; vinyl esters such as vinyl acetate, vinyl propionate, vinyl benzoate, and vinyl butyrate; a-methylene fatty monocarboxylic acid esters such as methyl acrylate, phenyl acrylate, octyl acrylate, methyl methacrylate, ethyl methacrylate, butyl methacrylate, and dodecyl methacrylate; vinyl ethers such as vinyl methyl ether, vinyl ethyl ether, and vinyl butyl ether; and vinyl ketones such as vinyl methyl ketone, vinyl hexyl ketone, and vinyl isopropenyl ketone. Representative examples of the binder resin among these include polystyrene, styrene-alkyl acrylate copolymer, styrene-butadiene copolymer, styrene-maleic anhydride copolymer, and polypropylene. Other examples of the binder resin include polyesters, polyurethanes, epoxy resins, silicone resins, polyamides, and modified rosins.

—Colorant—

The colorant is not particularly limited. Examples thereof include carbon black, aniline blue, CALCO OIL blue, chrome yellow, ultramarine blue, DU PONT oil red, quinoline yellow, methylene blue chloride, phthalocyanine blue, malachite green oxalate, lamp black, rose bengal, C. I. Pigment Red 48:1, C. I. Pigment Red 122, C. I. Pigment Red 57:1, C. I. Pigment Yellow 97, C. I. Pigment Yellow 12, C. I. Pigment Blue 15:1, and C. I. Pigment Blue 15:3.

—Releasing Agent—

Examples of the releasing agent include paraffin wax and derivatives thereof, montan wax and derivatives thereof, microcrystalline wax and derivatives thereof, Fischer-Tropsch wax and derivatives thereof, and polyolefin wax and derivatives thereof. The "derivatives" include oxides, polymers with vinyl monomers, and graft-modified compounds. Other examples of the releasing agent include alcohols, fatty acids, vegetable wax, animal wax, mineral wax, ester wax, and acid amides.

—Charge Control Agent—

The core particle may contain a charge control agent if needed. When the toner particles are used in a color toner, a colorless or light-colored charge control agent that does not affect the color tone may be used. A known charge control agent may be used. Examples thereof include azo-based metal complexes and metal complexes and metal salts of salicylic acid or alkyl salicylic acid.

—Inorganic Oxide Particles—

The core particles may contain inorganic oxide particles inside. Examples of the inorganic oxide particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, and $MgSO_4$. Of these, silica particles and titania particles are particularly preferable as the organic oxide particles. The surface of the inorganic oxide particles may or may not be hydrophobized in advance. Hydrophobing the inorganic oxide particles suppresses the environmental dependency of charging and carrier contamination even when the inorganic oxide particles in the toner particle are exposed in the toner surface.

The inorganic oxide particles are hydrophobized by dipping inorganic oxide particles in a hydrophobing agent, for example.

The hydrophobing agent is not particularly limited. Examples thereof include silane coupling agents, silicone oil, titanate coupling agents, and aluminum coupling agents. These may be used alone or in combination. Among these, silane coupling agents are preferred. Examples of the silane coupling agents include chlorosilane, alkoxysilane, silazane, and special silylation reagent. Examples of the silane coupling agent are the same as the examples of the surface-treating agent for the inorganic oxide particles used as an external additive described below.

The amount of the hydrophobing agent differs depending on the type of the inorganic oxide particles and is not uniformly defined. For example, 5 to 50 parts by mass of the hydrophobing agent may be used per 100 parts by mass of the inorganic oxide particles.

<Method for Preparing Toner Particles>

—Method for Preparing Core Particles—

The method for preparing the core particles may be a kneading and pulverizing method or a wet granulation method commonly employed. Examples of the wet granulation method include a suspension polymerization method, an emulsion polymerization method, an emulsion polymerization/agglomeration method, a soap-free emulsion polymerization method, a nonaqueous dispersion polymerization method, an in-situ polymerization method, an interfacial polymerization method, an emulsion dispersion granulation method, and an agglomeration/coalescence method.

When a kneading and pulverizing method is employed, for example, a binder resin and, if needed, a colorant and other additives are mixed in a mixer such as a HENSCHEL, mixer or a ball mill, and the mixture is melt-kneaded with a thermal kneader such as hot rollers, a kneader, or an extruder so that the resins are compatibilized with each other. Thereto, an infrared absorber, an antioxidant, etc., are dispersed or dissolved as needed, and the mixture is solidified by cooling, ground, and classified to obtain core particles.

When a wet granulation method is employed, for example, the following agglomeration/coalescence method may be employed.

In particular, core particles are obtained through a dispersion preparation step of preparing a dispersion in which first particles containing the binder resin (hereinafter, the first particles are also referred to as "resin particles") are dispersed, an agglomerated particle forming step of forming agglomerated particles containing the first particles by agglomerating the first particles, and a coalescing step of coalescing the agglomerated particles by heating.

The individual steps will now be described.

(Dispersion Preparation Step)

In the dispersion preparation step, a dispersion in which resin particles containing a binder resin are dispersed (hereinafter this dispersion is also referred to as "raw material dispersion") is prepared. When the core particles contain components other than the binder resin, a resin particle dispersion containing dispersed resin particles and a dispersion containing other components dispersed therein may be separately prepared and mixed to prepare a raw material dispersion.

For example, when the core particles contain a colorant and a releasing agent in addition to the binder resin, a resin particle dispersion containing dispersed resin particles, a colorant dispersion containing dispersed particles of a colorant, and a releasing agent dispersion containing dispersed particles of a releasing agent may be separately prepared and then mixed with each other to prepare a raw material dispersion in which the resin particles, colorant particles, and releasing agent particles are dispersed.

The volume-average particle size of the resin particles dispersed in the resin particle dispersion may be in the range of 0.01 μm to 1 μm, more preferably in the range of 0.03 μm to 0.8 μm, and most preferably in the range of 0.03 μm to 0.6 μm.

The volume-average particle size of the particles, such as resin particles, contained in the raw material dispersion is determined with a laser particle size distribution analyzer LA-700 produced by HORIBA LTD.

The dispersion medium for the resin particle dispersion and other dispersions may be, for example, an aqueous medium.

Examples of the aqueous medium include water such as distilled water and ion exchange water, and alcohols. These may be used alone or in combination. A surfactant may be added to the aqueous medium.

The surfactant is not particularly limited. Examples thereof include anionic surfactants such as salts of sulfuric acid ester, salts of sulfonic acid, phosphoric esters, and soaps; cationic surfactants such as amine salts and quaternary ammonium salts; and nonionic surfactants such as polyethylene glycol, alkyl phenol ethylene oxide adducts, and polyhydric alcohol. Among these, anionic surfactants and cationic surfactants are particularly preferable. The nonionic surfactants may be used in combination with the anionic or cationic surfactant. The surfactants may be used alone or in combination.

Examples of the method for dispersing a binder resin into a dispersion medium include common dispersion methods that use a rotational shear homogenizer or a mill containing media such as a ball mill, a sand mill, or a dyno mill. The resin particle dispersion may be prepared by a phase-inversion emulsification method depending on the type of the binder resin used. A phase-inversion emulsification method is a method for dispersing resin particles in an aqueous medium by dissolving a resin to be dispersed in a hydrophobic organic solvent that dissolves the resin, adding a base to an organic continuous phase (O phase) to conduct neutralization, and injecting a water medium (W phase) thereto so that the resin is converted from W/O to O/W (phase inversion) to form a noncontinuous phase.

The resin particle content in the resin particle dispersion is, for example, 5 mass % to 50 mass % and may be 10 mass % to 40 mass %.

The volume-average particle size, the dispersion medium, the dispersion method, and the particle content are the same for the colorant particles dispersed in the colorant dispersion and the releasing agent particles dispersed in the releasing agent dispersion.

(Agglomerated Particle Forming Step)

In the agglomerated particle forming step, agglomerated particles containing resin particles are formed by agglomerating the resin particles. For example, after an agglomerating agent is added to the raw material dispersion, the raw material dispersion is heated to a melting temperature of the binder resin or less (e.g., in the range from a temperature 20° C. lower than the melting temperature of the binder resin to the melting temperature of the binder resin) to agglomerate the dispersed particles in the raw material dispersion, thereby forming agglomerated particles. It should be noted that in the case where core particles containing a colorant and a releasing agent in addition to the binder resin are to be prepared, agglomerated particles containing the resin particles, the colorant particles, and the releasing agent particles are prepared.

In the agglomerated particle forming step, for example, the agglomerating agent may be added to the raw material dispersion under stirring in a rotational shear homogenizer at room temperature (e.g., 25° C.), pH of the raw material dispersion may be adjusted to acidic (e.g., pH or 2 to 5), and a dispersion stabilizer may be added if needed, followed by the heating process described above.

Examples of the agglomerating agent used in the agglomerated particle forming step include surfactants having the opposite polarity from the surfactant used as a dispersant added to the raw material dispersion, e.g., inorganic metal salts and metal complexes having a valence of 2 or more. When a metal complex is used as an agglomerating agent, the amount of surfactant used is reduced and the charging characteristics are improved.

An additive that forms a complex with a metal ion of the agglomerating agent or a bond similar to this may be used depending on need. The additive may be a chelating agent.

Examples of the inorganic metal salts include metal salts such as calcium chloride, calcium nitrate, barium chloride, magnesium chloride, zinc chloride, aluminum chloride, and aluminum sulfate and inorganic metal salt polymers such as polyaluminum chloride, polyaluminum hydroxide, and polycalcium sulfide.

A water-soluble chelating agent may be used as the chelating agent. Examples of the chelating agent include oxycarboxylic acid such as tartaric acid, citric acid, and gluconic acid, iminodi acid (IDA), nitrilotriacetic acid (NTA), and ethylene diamine tetraacetic acid (EDTA).

The amount of the chelating agent added is, for example, 0.01 parts by mass to 5.0 parts by mass and may be 0.1 parts by mass or more and less than 3.0 parts by mass relative to 100 parts by mass of the binder resin.

(Coating Step)

A coating step may be performed after the agglomerated particle forming step, if necessary. In the coating step, the surfaces of the agglomerated particles formed in the agglomerated particle forming step are coated with resin particles for coating.

The coating step may involve, for example, further adding a dispersion containing binder resin particles to the raw material dispersion containing agglomerated particles formed in the agglomerated particle forming step. The binder resin constituting the particles used in the coating step may be the same as or different from the binder resin contained in the agglomerated particles.

The coating step is followed by the coalescing step described below. The coating step and the coalescing step may be alternately repeatedly.

(Coalescing Step)

In the coalescing step following the agglomerated particle forming step (and the coating step if needed), pH of the dispersion containing the agglomerated particles (or coated agglomerated particles) formed though the subsequent steps is adjusted in, for example, a range of 6.5 to 8.5 to terminate the agglomeration.

After the agglomeration is terminated, the agglomerated particles are heated (e.g., heated to a temperature equal to or higher than the melting temperature of the binder resin) to coalesce the agglomerated particles.

—Method for Forming Coating Layer—

The coating layer is formed on the surface of the core particle by polymerizing monomers on the surface of the core particle, as mentioned earlier.

For example, a monomer having a boric acid-reactive group and other optional monomers (the "monomer having a boric acid-reactive group" and other "monomers" may be collectively referred to as "monomers" hereinafter) may be added to the dispersion in which core particles are dispersed in a dispersion medium. After the monomers are polymerized on the surfaces of the core particles, a boric acid or the like may be added to form boron crosslinked structures.

The method for forming the coating layer is not limited to the aforementioned method of adding boric acid or the like after completion of the polymerization. Boric acid or the like may be added before polymerization so that boron crosslinked structures are formed as the polymerization proceeds. Alternatively, boric acid or the like may be added during the course of the polymerization.

The polymerization method is selected according to the types of monomers used. For example, a polymerization method including heating (heating to a temperature of, for example, 25° C. to 90° C.) a dispersion containing the monomers may be employed. The boron crosslinked structures are formed by adjusting the temperature of the dispersion to 25° C. to 50° C. and adding boric acid or the like.

The core particles dispersed in the dispersion are obtained by the aforementioned method of forming the core particles, for example. In the case where the core particles obtained through the agglomeration/coalescence method are used, coating layers may be formed on the surfaces of the core particles formed through the coalescing step. However, the method is not limited to this. For example, the monomers may be added and heated before the coalescing step so that the monomers are polymerized along with the progress of the coalescing step and that the monomers are polymerized on the surfaces of the core particles.

The dispersion medium is not particularly limited. Examples thereof are the same as those of the dispersion medium of the resin particle dispersion, for example.

A surfactant and the like may be added to the dispersion of the core particles in addition to the dispersion medium. Examples of the surfactant are the same as those of the surfactant used in the resin particle dispersion, for example.

In forming the coating layer, the amount of the boric acid or the like added relative to 100 parts by mass of the monomers added (the total amount of the monomer having the boric acid-reactive group and other optional monomers) is, for example, 5 to 500 parts by mass and may be 20 to 200 parts by mass.

In forming the coating layer, the amount of boric acid or the like added relative to one mole of the boric acid-reactive group in the monomer added to the dispersion is, for example, 0.05 to 1 mol and may be 0.1 to 0.8 mol.

In forming the coating layer, the amount of the monomers added (the total amount of the monomer having the boric acid-reactive group and other optional monomers) relative to 100 parts by mass of core particles is, for example, 0.1 to 50 parts by mass and may be 0.5 to 30 parts by mass.

After the coating layers are formed on the surfaces of the core particles, for example, a washing step, a solid-liquid separation step, and a drying step are performed to obtain toner particles.

In the washing step, for example, the dispersant adhering on the toner particles are removed by using an aqueous solution of a strong acid such as hydrochloric acid, a sulfuric acid, or nitric acid, and the toner particles are washed with ion exchange water or the like until the filtrate is neutral.

The solid-liquid separation step is not particularly limited. For example, suction filtration or pressure filtration may be employed. The drying step is not particularly limited. For example, freeze drying, flash jet drying, fluidized drying, or vibration-type fluidized drying may be employed.

In the drying step, a typical vibration-type fluidized drying method, a spray drying method, a freeze drying method, a flash jet drying method, or the like may be employed. The water content in the toner particles after drying is, for example, 1.0 mass % or less and may be 0.5 mass % or less.

—Method of Confirming Whether Boron Crosslinked Structure is Present ($^1$H-NMR Analysis)—

Whether the coating layer formed as described above is composed of a boron crosslinked resin (whether boron atoms contribute to formation of the crosslinked structure) may be confirmed through, for example, $^1$H-NMR analysis described below.

For example, a $^1$H-NMR spectrum before formation of the boron crosslinked structure and a $^1$H-NMR after formation of the boron crosslinked structure (in other words, the boron crosslinked resin formed on the surfaces of the core particles)

are measured. Then how a chemical shift value attributable to a hydrogen atom bonded to a carbon atom directly bonding to a boron reactive group in the boron reactive group-containing polymer compound (or a monomer containing a boron reactive group) before formation of the boron crosslinked structure changes as a result of the formation of the boron crosslinked structure is investigated to confirm whether or not the boron crosslinked structure is formed.

An example in which a boron crosslinked structure is formed as a result of a reaction between trimethyl borate and a hydroxyl group, i.e., a boron reactive group, of glycerin monomethacrylate is described below as an example in which a boron crosslinked structure is formed.

The $^1$H-NMR spectrum of glycerin monomethacrylate (GLM) is compared with the $^1$H-NMR spectrum of the reaction product between GLM and trimethyl borate. As described below, the peak attributable to the 2-position proton of GLM is shifted from 3.94 ppm to 3.69 ppm and the peak attributable to the 3-position proton of GLM is shifted from 3.49 ppm to 3.24 ppm. Whether a boron crosslinked structure is formed is confirmed by comparing the $^1$H-NMR spectrum of the raw material, i.e., the monomer having a boron reactive group, and the $^1$H-NMR spectrum of the obtained toner particles by utilizing this tendency.

Alternatively, an acid treatment (described below in the section "Method of confirming boron crosslinked structure (based on gel component") of the boron crosslinked resin may be conducted and while performing $^1$H-NMR analysis before and after the acid treatment. Whether the boron crosslinked structure has been formed is confirmed from the difference in the chemical shift value.

[Chem. 1]

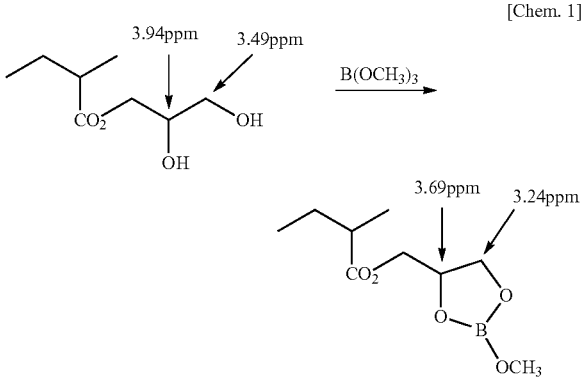

—Method for Confirming Boron Crosslinked Structure (Based on Infrared Absorption Spectrum)—

Whether the obtained resin is boron-crosslinked or not may be confirmed by taking an infrared absorption spectrum. To be more specific, KBr with an adequate amount of a sample resin mixed therein is molded to form a sample. Then an infrared absorption spectrum is taken from this sample. In an infrared absorption spectrum of alkyl borate, the vibration of the boric acid has an absorption wavelength at 1380 cm$^{-1}$ and the absorption wavelength shifts to 1310 cm$^{-1}$ once a crosslink is formed. This helps determine whether the resin is crosslinked or dissociated.

—Method for Confirming Boron Crosslinked Structure (Based on Gel Component)—

Another possible method for confirming the boron crosslinked structure is a method that utilizes the property of the boron crosslinked structure dissociating with an acid.

For example, a weighed sample (boron crosslinked resin) may be placed in an Erlenmeyer flask, 20 ml of a special grade toluene at room temperature (25° C.) is poured into the flask, and the mixture is stirred for four hours at room temperature (25° C.) and kept in a refrigerator (5° C.) overnight (6 hours or more). The mixture is then placed in a centrifuge tube of a centrifugal separator and centrifugally separated for 20 minutes at a speed of 12,000 turns per hour. The centrifuge tube after centrifugal separation is left standing at room temperature (25° C.) for 1.5 hours. Then the lid of the centrifugal tube is opened and the supernatant is taken out with a micropipette.

Then insoluble precipitate is dried and obtained as a gel component.

The gel component is then treated with an acid. That is, to an acid which is an acidic solution containing 10 ml water and 1 ml of 0.3 mol/L nitric acid, 1 g of the gel component is added, and the mixture is stirred at room temperature (25° C.) for 1 hour. Then the gel component is separated by filtration or the like, dried at room temperature, and treated with an acid.

After the acid treatment, 20 ml of a special grade toluene at room temperature (25° C.) is poured into the flask, and the mixture is stirred for four hours at room temperature (25° C.) and kept in a refrigerator (5° C.) overnight (6 hours or more). The mixture is then placed in a centrifuge tube of a centrifugal separator and centrifugally separated for 20 minutes at a speed of 12,000 turns per hour. The centrifuge tube after centrifugal separation is left standing at room temperature (25° C.) for 1.5 hours. The lid of the centrifugal tube is opened, and 2.5 ml of supernatant is taken with a micropipette and placed in an aluminum dish separately weighed. The toluene component is evaporated by using a hot plate. The aluminum dish is vacuum-dried for 8 hours. The weight of the aluminum dish after vacuum drying is measured and the content of the gel having the boron crosslinked structure is calculated by the following equation.

$$\text{Content of gel having boron crosslinked structure}(\%)=\{A'-[(B'-C')\times 8]\}/A'\times 100$$

A': mass of sample [g]

B': total mass of toluene solubles and aluminum dish [g]

C': mass of aluminum dish only [g]

<Properties of Toner Particles>

The shape factor SF1 of the toner particles obtained by the wet granulation method is, for example, 110 or more and 140 or less. The shape factor SF1 may be quantified by analyzing a microscope image or a scanning electron microscope image with an image analyzer, for example. For example, the shape factor SF1 may be determined by capturing an optical microscope image (e.g., an image magnified by 250 times) of toner particles scattered on a slide glass through a video camera to a LUZEX image analyzer (LUZEX III produced by NIRECO CORPORATION), calculating SF1 for 50 or more toner particles based on the equation below, and averaging the obtained SF1.

$$SF1=(ML^2/A)\times(\pi/4)\times 100$$

where ML represents an absolute maximum length of a particle and A represents a projection area of the particle.

The volume-average particle size of the toner particles is, for example, in the range of 3.5 μm to 9 μm. The volume-average particle size distribution index (GSDv) is in the range of 1.10 to 1.25.

As for the particle size distribution of the toner particles, the toner particles having a particle size 3 μm or less may account for 6% to 25% or 6% to 16% of the total number of the toner particles on a particle number basis. The toner particles having a particle size 16 μm or more may account for 1.0 vol. % or less, for example.

The particle size distribution and volume-average particle size of the toner particles are determined with COULTER MULTISIZER II (produced by BECKMAN COULTER) and an electrolyte, ISOTON-II (produced by BECKMAN COULTER). The measured particle size distribution is plotted versus divided particle size ranges (channels) to draw a cumulative distribution for the volume from a small size side. The particle size at which 50% accumulation is given is defined as the volume-average particle size.

The particle diameter providing 16% accumulation is defined as that corresponding to volume $D_{16v}$ and number $D_{16p}$ and the particle diameter providing 84% accumulation is defined as that corresponding to volume $D_{84v}$ and number $D_{84p}$. The volume-average particle size distribution index (GSDv) is calculated as $(D_{84v}/D_{16v})^{1/2}$ using these values.

<External Additive>

According to the toner of this exemplary embodiment, an external additive may be added to surfaces of the toner particles if needed. Examples of the external additive include inorganic and organic particles.

Examples of the inorganic oxide particles include inorganic oxide particles such as $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)$ n, $Al_2O_3.2\ SiO_2$, $CaCO_3$ $MgCO_3$, $EaSO_4$ and $MgSO_4$, barium titanate, magnesium titanate, calcium titanate, strontium titanate, silica sand, clay, mica, wollastonite, diatomaceous earth, cerium chloride, red iron oxide, chromium oxide, antimony trioxide, silicon carbide, and silicon nitride. Of these, silica particles and titania particles are particularly preferable as the inorganic oxide particles.

When the organic oxide particles are used as an external additive, surfaces of the organic oxide particles may be hydrophobized. Hydrophobing the surfaces of the inorganic oxide particles improves the powder flowability of the toner and suppresses the environmental dependency of charging and carrier contamination.

Hydrophobing is conducted, for example, by dipping inorganic oxide particles in a hydrophobing agent, as described above. The hydrophobing agent is not particularly limited. Examples thereof include silane coupling agents, silicone oil, titanate coupling agents, and aluminum coupling agents. These may be used alone or in combination. Among these, silane coupling agents are preferred.

Examples of the silane coupling agents include chlorosilane, alkoxysilane, silazane, and special silylation reagent. Specific examples of the silane coupling agent include methyltrichlorosilane, dimethyldichlorosilane, trimethylchlorosilane, phenyltrichlorosilane, diphenyldichlorosilane, tetramethoxysilane, methyltrimethoxysilane, dimethyldimethoxysilane, phenyltrimethoxysilane, diphenyldimethoxysilane, tetraethoxysilane, methyltriethoxysilane, dimethyldiethoxysilane, phenyltriethoxysilane, diphenyldiethoxysilane, isobutyltriethoxysilane, decyltrimethoxysilane, hexamethyldisilazane, N,O-(bistrimethylsilyl)acetamide, N,N-(trimethylsilyl)urea, tert-butyldimethylchlorosilane, vinyltrichlorosilane, vinyltrimethoxysilane, vinyltriethoxysilane, γ-methacryloxypropyltrimethoxysilane, β-(3,4-epoxycyclohexyl)ethyltrimethoxysilane, γ-glycidoxypropyltrimethoxysilane, γ-glycidoxypropylmethyldiethoxysilane, γ-mercaptopropyltrimethoxysilane, and γ-chloropropyltrimethoxysilane.

The amount of the hydrophobing agent differs depending on the type of the inorganic oxide particles and is not uniformly defined, as described above. For example, 5 to 50 parts by mass of the hydrophobing agent may be used per 100 parts by mass of the inorganic oxide particles.

The inorganic particles are used to improve flowability, for example. The primary particle size of the inorganic particles is, for example, 1 nm or more and less than 200 nm. The amount of the inorganic particles added is, for example, 0.01 parts by mass to 20 parts by mass relative to 100 parts by mass of the toner particles.

Examples of the organic particles include polystyrene, polymethyl methacrylate, and polyvinylidene fluoride. For example, the organic particles may be used to improve cleaning property and transfer property.

Examples of the method for adding the external additive to the surfaces of the toner particles include methods of mixing the toner particles with the external additive by using a V blender, a HENSCHEL mixer, or a LODIGE mixer.

[Electrostatic Image Developer]

The electrostatic image developer of the exemplary embodiment (also referred to as "developer" hereinafter) is not particularly limited as long as it contains a toner of the exemplary embodiment. The developer may be a one-component developer or a two-component developer. When a two-component developer is used, a toner and a carrier are mixed and used.

The carrier in the two-component developer is not particularly limited. Examples thereof include magnetic metals such as iron, nickel, and cobalt, magnetic oxides such as ferrite and magnetite, a resin-coated carrier including a core and a resin coating layer on the surface of the core, and a magnetic dispersion-type carrier. The carrier may be a resin dispersion-type carrier in which a conductive material or the like is dispersed in a matrix resin.

Examples of the coating resin and matrix resin used in the carrier include, but are not limited to, polyethylene, polypropylene, polystyrene, polyvinyl acetate, polyvinyl alcohol, polyvinyl butyral, polyvinyl chloride, polyvinyl ether, polyvinyl ketone, vinyl chloride-vinyl acetate copolymers, styrene-acrylic acid copolymers, straight silicone resin including organosiloxane bonds and its modified products, fluorine resin, polyester, polycarbonate, phenolic resin, and epoxy resin.

Examples of the conductive material include, but are not limited to, metals such as gold, silver, and copper, carbon black, titanium oxide, zinc oxide, barium sulfate, aluminum borate, potassium titanate, and tin oxide.

Examples of the core of the carrier include magnetic metals such as iron, nickel, and cobalt, magnetic oxides such as ferrite and magnetite, and glass beads. The carrier may be a magnetic material if it is to be used in a magnetic brush method.

The volume-average particle size of the core of the carrier is, for example, in the range of 10 μm to 500 μm and may be in the range of 30 μm to 100 μm.

The surface of the core of the carrier may be coated with a resin by using a coating layer-forming solution containing the coating resin and, if needed, various additives dissolved in a solvent. The solvent is not particular limited and may be adequately selected by considering the type of coating resin used, suitability to coating, etc.

Specific examples of the resin coating method include a dipping method including dipping the core of the carrier in a coating layer-forming solution; a spraying method including spraying a coating layer-forming solution onto the surface of the core of the carrier; a fluid bed method including spraying a coating layer-forming solution while having the core of the carrier floating by using a flowing air; and a kneader coater method including mixing the core of the carrier with a coating layer-forming solution in a kneader coater and removing the solvent.

The mixing ratio (mass ratio) of the toner to the carrier in the two-component developer is adjusted so that the mass of the toner is 0.01 to 0.3 times the mass of the carrier. The mass of the toner may be 0.03 to 0.2 times the mass of the carrier.

The developer of the exemplary embodiment may be used as a developer to be housed in a developing device of an image forming apparatus described below. Alternatively, for example, the developer may be used as a replenishing developer used in a so-called trickle development system in which a carrier is also replenished in addition to the toner consumed so that the carrier in the developing device is renewed to suppress changes in charge amount and stabilize the image density.

The mixing ratio (mass ratio) of the toner to the carrier in the two-component developer to be used as such a replenishing developer is adjusted so that the mass of the toner is at least 2 times, 3 times, or 5 times the mass of the carrier.

[Image Forming Apparatus]

An image forming apparatus according to an exemplary embodiment that uses the electrostatic image developing toner of the exemplary embodiment will now be described.

The image forming apparatus of the exemplary embodiment includes an image-carrying member; a charging unit that charges a surface of the image-carrying member; an electrostatic image-forming unit that forms an electrostatic image on the charged surface of the image-carrying member; a developing unit that develops the electrostatic image on the surface of the image-carrying member with the electrostatic image developer of the exemplary embodiment to form a toner image; a transfer unit that transfers the toner image on the surface of the image-carrying member onto a surface of a transfer-carrying body; and a fixing unit that fixes the toner image transferred onto the surface of the transfer-carrying body.

The image-forming speed of the image forming apparatus of the exemplary embodiment is, for example, 500 mm/sec or more and may be 550 mm/sec or more and 700 mm/sec or less.

The developing unit may include a developer-carrying member that retains the electrostatic image developer of the exemplary embodiment. The difference in speed between the surface of the image-carrying member and the surface of the developer-carrying member in terms of the ratio of the rotating speed of the surface of the image-carrying member to the rotating speed of the surface of the developer-carrying member is, for example, 1:1.5 or more and 1:5 or less.

The peripheral velocity of the developer-carrying member, i.e., the travel distance on the surface of the developer-carrying member, is, for example, 400 mm/s or more and may be 450 mm/s or more. The peripheral velocity of the developer-carrying member may be 1500 mm/s or less or 1200 mm/s or less.

The developing unit may include, for example, a developer housing container for housing a developer; a developer supplying unit that supplies a replenishing developer to the developer housing container; and a developer discharging unit that discharges at least part of the developer housed in the developer housing container. In other words, the developing unit may employ a trickle development system.

The mixing ratio of the toner to the carrier in the replenishing developer is, for example, mass of toner/mass of carrier ≥2, mass of toner/mass of carrier ≥3, or mass of toner/mass of carrier ≥5.

The image forming apparatus of the exemplary embodiment may further include a cleaning unit including a cleaning blade or the like, a charge erasing unit, etc., in addition to the aforementioned units.

A portion that includes the developing unit of the image forming apparatus of the exemplary embodiment may be configured as a cartridge (process cartridge) detachably attachable to the main body of the image forming apparatus.

A non-limiting example of the image forming apparatus of the exemplary embodiment will now be described. Only the relevant components are described below.

FIG. 1 is a schematic diagram showing a color image forming apparatus of a four-drum tandem system. The image forming apparatus shown in FIG. 1 includes first to fourth electrophotographic image forming units 10Y, 10M, 10C, and 10K that respectively output yellow (Y), magenta (M), cyan (C), and black (K) images on the basis of color-separated image data. The image forming units (may be referred to as "units" hereinafter) 10Y, 10M, 10C, and 10K are arranged side-by-side in the horizontal direction at predetermined intervals. The units 10Y, 10M, 10C, and 10K may be configured as a process cartridge detachably attached to the main body of the image forming apparatus.

An intermediate transfer belt 20 that functions as an intermediate transfer member is disposed above the units 10Y, 10M, 10C, and 10K in the drawing. The intermediate transfer belt 20 is stretched over a driving roller 22 and a support roller 24 in contact with the inner surface of the intermediate transfer belt. The driving roller 22 and the support roller 24 are apart from each other in the direction that extends from the left side of the drawing to the right side of the drawing. The intermediate transfer belt is configured to run in the direction from the first unit 10Y to the fourth unit 10K. Force is applied to the support roller 24 with a spring or the like not shown in the drawing in the direction away from the driving roller 22 so that tension is applied to the intermediate transfer belt 20 stretched over the two rollers. An intermediate transfer member cleaning device 30 opposing the driving roller 22 is provided on the image-carrying member-side of the intermediate transfer belt 20.

Yellow, magenta, cyan, and black toners in toner cartridges 8Y, 8M, 8C, and 8K are respectively supplied to developing units 4Y, 4M, 4C, and 4K of the units 10Y, 10M, 10C, and 10K.

Since the first to fourth units 10Y, 10M, 10C, and 10K have identical structures, the first unit 10Y configured to form an yellow image and disposed on the upstream side in the intermediate transfer belt running direction is described as a representative example. The descriptions of the second to fourth units 10M, 10C, and 10K are omitted by giving reference numerals having magenta (M), cyan (C), and black (K) attached to the numerals.

The first unit 10Y includes a photoconductor 1Y as an image-carrying member. A charging roller 2Y (charging unit) that charges the surface of the photoconductor 1Y to a predetermined potential, an exposing device 3 (electrostatic image forming unit) that forms an electrostatic image by exposing the charged surface with a laser beam 3Y on the basis of a color-separated image signal, a developing device 4Y (developing unit) that develops the electrostatic image by supplying a charged toner to the electrostatic image, a primary transfer roller 5Y that transfers the developed toner image onto the intermediate transfer belt 20, and a photoconductor cleaning device 6Y that removes the toner remaining on the surface of the photoconductor 1Y after the primary transfer are provided around the photoconductor 1Y. The electrostatic image forming unit includes the charging roller 2Y and the exposing device 3. The transfer unit includes the primary transfer roller 5Y, the intermediate transfer belt 20, and a secondary transfer roller 26 described below.

The primary transfer roller 5Y is disposed in the inner side of the intermediate transfer belt 20 and opposes the photoconductor 1Y. Bias power supplies (not shown in the drawing) that apply a primary transfer bias are respectively connected to the primary transfer rollers 5Y, 5M, 5C, and 5K. The bias power supplies change the transfer bias applied to the primary transfer rollers by being controlled by a controller not shown in the drawing.

Operation of forming an yellow image by using the first unit 10Y will now be described. Prior to operation, the surface of the photoconductor 1Y is charged to a potential of about −600 V to about −800 V by using the charging roller 2Y.

The photoconductor 1Y is formed by layering a photosensitive layer on an electrically conductive (volume resistivity at 20° C.: $1\times10^{-6}$ Ωcm or less) base. The photosensitive layer normally has a high resistivity (a resistivity of common resin) but when irradiated with the laser beam 3Y, the resistivity of the portion irradiated with the laser beam changes. The laser beam 3Y is output to the charged surface of the photoconductor 1Y through the exposing device 3 in accordance with the yellow image data transmitted from the controller (not shown). The laser beam 3Y hits the photosensitive layer on the surface of the photoconductor 1Y and an electrostatic image of an yellow print pattern is thereby formed on the surface of the photoconductor 1Y.

An electrostatic image is an image formed on the surface of the photoconductor 1Y by charging. A portion of the photosensitive layer irradiated with the laser bean 3Y exhibits a lower resistivity and thus the charges in that portion flow out while charges remain in the rest of the photosensitive layer not irradiated with the laser beam 3Y. Since the electrostatic image is formed by such residual charges, it is a negative latent image.

The electrostatic image formed on the photoconductor 1Y is rotated to a predetermined developing position as the photoconductor 1Y is run. The electrostatic image on the photoconductor 1Y is visualized (developed) with the developing device 4Y at this developing position.

An electrostatic image developer containing at least an yellow toner is housed in the developing device 4Y. The yellow toner is frictionally charged as it is stirred in the developing device 4Y and carried on the developer roller (developer-carrying member) by having charges having the same polarity (negative) as the charges on the photoconductor 1Y. As the surface of the photoconductor 1Y pass by the developing device 4Y, the yellow toner electrostatically adheres on the latent image portion on the photoconductor 1Y from which charges are erased and the latent image is thereby developed with the yellow toner.

From the standpoints of development efficiency, image graininess, and tone reproducibility, a bias potential (development bias) formed by superimposing AC components to DC components may be applied to the developer-carrying member. In particular, when the DC voltage Vdc applied to the developer-carrying member is in the range of −300 to −700, the AC voltage peak width Vp-p for the developer-carrying member may be set within the range of 0.5 to 2.0 kV.

The photoconductor 1Y on which the yellow toner image is formed is continuously moved at a predetermined velocity to transport the developed toner image on the photoconductor 1Y to a predetermined primary transfer position.

After the yellow toner image on the photoconductor 1Y is transported to the primary transfer position, a primary transfer bias is applied to the primary transfer roller 5Y. Electrostatic force working from the photoconductor 1Y toward the primary transfer roller 5Y also works on the toner image and the toner image on the photoconductor 1Y is transferred onto the intermediate transfer belt 20. The transfer bias applied at this time has a polarity opposite to that (negative) of the toner, i.e., the polarity of the transfer bias is positive. For example, the transfer bias for the first unit 10Y is controlled to about +10 μA by the controller (not shown).

The toner remaining on the photoconductor 1Y is removed by the cleaning device 6Y and recovered.

The primary transfer bias applied to the primary transfer rollers 5M, 5C, and 5K of the second to fourth units 10M to 10K are also controlled as with the first unit.

The intermediate transfer belt 20 onto which the yellow toner image has been transferred by using the first unit 10Y is transported through the second to fourth units 10M, 10C, and 10K. Toner images of other colors are superimposed on the yellow toner image to achieve multiple transfer.

The intermediate transfer belt 20 onto which the toner images of four colors are transferred using the first to fourth units then reaches a secondary transfer section constituted by the intermediate transfer belt 20, the support roller 24 in contact with the intermediate transfer belt inner surface, and the secondary transfer roller 26 disposed on the image-carrying surface side of the intermediate transfer belt 20. Meanwhile, a recording sheet P (receiving member) is fed at a predetermined timing from a feeding mechanism to a space where the secondary transfer roller 26 and the intermediate transfer belt 20 contact each other, and a secondary transfer bias is applied to the support roller 24. The transfer bias applied has the same polarity as the toner (negative). The electrostatic force from the intermediate transfer belt 20 toward the recording sheet P works on the toner image, and the toner image on the intermediate transfer belt 20 is transferred onto the recording sheet P. The secondary transfer bias is determined by the resistance of the second transfer section detected with a resistance detector (not shown) and is controlled by voltage.

Subsequently, the recording sheet P is sent to the contact portion between a pair of fixing rollers in the fixing device 28 (fixing unit). The superimposed toner images are thermally melted and fixed on the recording sheet P.

Examples of the receiving member onto which the toner images are transferred include regular paper used in electrophotographic system copiers and printers and OHP sheets.

The recording sheet P upon completion of the fixing of the color image is transported toward the discharging unit to terminate a series of color image forming operations.

Although the image forming apparatus has a structure in which toner images are transferred onto the recording sheet P by using the intermediate transfer belt 20, the structure is not limited to this. Alternatively, toner images may be directly transferred from the photoconductor onto the recording sheet.

According to the image forming apparatus of this exemplary embodiment, the toner of the exemplary embodiment is housed in the toner cartridge. The developer of the exemplary embodiment containing the toner of the exemplary embodiment and a carrier is housed in the developing device.

[Process Cartridge and Toner Cartridge]

Figure 2:
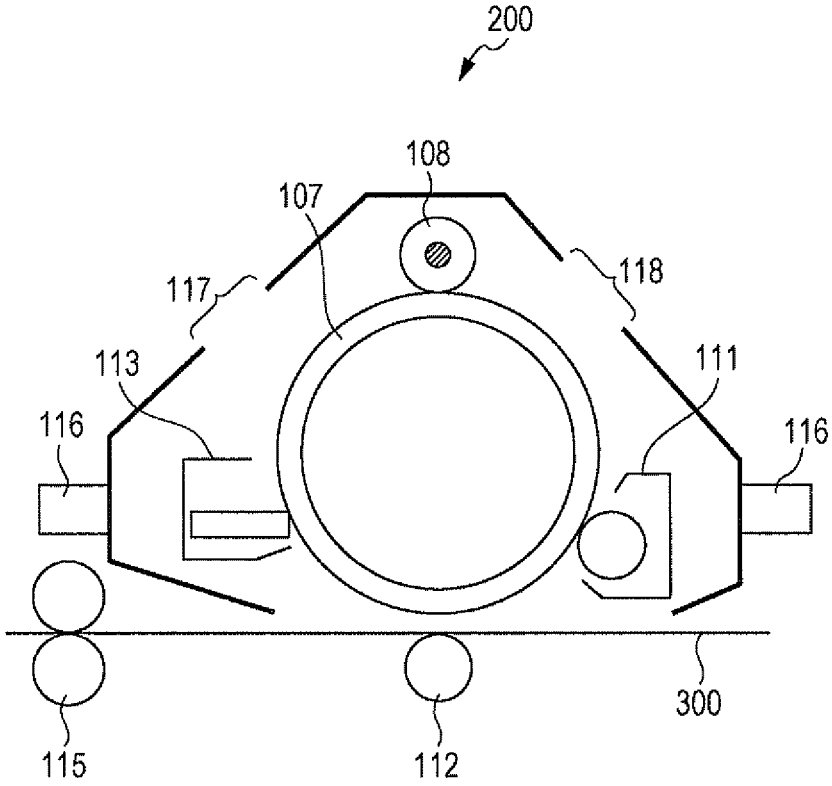
FIG. 2 is a schematic diagram showing one example of a process cartridge according to an exemplary embodiment.

FIG. 2 is schematic diagram showing an exemplary embodiment of a process cartridge housing the electrostatic image developer of the exemplary embodiment. A process cartridge 200 includes a developing device 111, a photoconductor 107, a charging roller 108, a photoconductor cleaning device 113, an aperture 118 for exposure, and an opening 117 for charge erasing by exposure which are assembled using an assembling rail 116. In FIG. 2, reference numeral 300 denotes a receiving member.

The process cartridge 200 is detachably attachable to the image forming apparatus main body that includes a transfer device 112, a fixing device 115, and other components (not shown in the drawing), and constitutes part of the image forming apparatus together with the image forming apparatus main body.

The process cartridge 200 shown in FIG. 2 includes the photoconductor 107, the charging roller 108, the developing device 111, the photoconductor cleaning device 113, the aperture 118 for exposure, and the opening 117 for charge erasing by exposure. These devices may be selectively combined. The process cartridge of this exemplary embodiment may include the developing device 111 and at least one selected from the group consisting of the photoconductor 107, the charging roller 108, the photoconductor cleaning device 113, the aperture 118 for exposure, and the opening 117 for charge erasing by exposure.

A toner cartridge of the exemplary embodiment will now be described. The toner cartridge of the exemplary embodiment is detachably attachable to the image forming apparatus and houses a toner supplied to the developing unit in the image forming apparatus. This toner is the aforementioned electrostatic image developing toner of the exemplary embodiment. The toner cartridge of the exemplary embodiment houses at least the toner, In certain embodiments, about 70% to about 95% of the interior volume of the toner cartridge is filled with the toner. Depending on the mechanism of the image forming apparatus, for example, a developer may be housed.

According to the image forming apparatus having a detachably attached toner cartridge, the electrostatic image developing toner of the exemplary embodiment is easily supplied to the developing device by using the toner cartridge containing the electrostatic image developing toner of the exemplary embodiment.

The image forming apparatus shown in FIG. 1 includes detachable toner cartridges 8Y, 8M, 8C, and 8K. The developing devices 4Y, 4M, 4C, and 4K are respectively connected to the toner cartridges of corresponding colors through toner supply ducts not shown in the drawing. When the amount of toner housed in the toner cartridge runs low, the toner cartridge is replaced.

In this embodiment, the image-carrying member is a photoconductor but not limited to this. For example, a dielectric recording member may be used.

When an electrophotographic photoconductor is used as the image-carrying member, the charging unit may be, for example, a corotron charger, a contact charger, or the like. The transfer unit may include a corotron charger.

[Image Forming Method]

An image forming method of the exemplary embodiment at least includes a charging step of charging a surface of an image-carrying member; an electrostatic image-forming step of forming an electrostatic image on the charged surface of the image-carrying member; a developing step of developing the electrostatic image on the surface of the image-carrying member with a developer to form a toner image; a transfer step of transferring the toner image on the surface of the image-carrying member onto a surface of a receiving member; and a fixing step of fixing the toner image transferred onto the surface of the receiving member. A developer that contains the electrostatic image developing toner of the aforementioned exemplary embodiment is used as the developer.

The image forming method may include steps other than the steps described above, if needed. Examples of such steps include a toner removing step of removing the toner remaining on the image-carrying body surface after the transfer step. The electrostatic image forming-step may include a step of charging a surface of the image-carrying member and a step of forming an electrostatic image on the charged surface of the image-carrying member. The transfer step may be a step of transferring a toner image from the image-carrying member onto a receiving member via an intermediate transfer member (intermediate transfer system).

In the developing step, for example, the difference in speed between the surface of the image-carrying member and the surface of the developer-carrying member in terms of the ratio of the rotating speed of the surface of the image-carrying member to the rotating speed of the surface of the developer-carrying member may be, for example, in the range of 1:1.5 or more and 1:5 or less.

The image-forming speed in the image-forming method of the exemplary embodiment is, for example, 500 mm/sec or more and may be 550 mm/sec or more and 700 mm/sec or less.

EXAMPLES

The exemplary embodiments will now be described in further detail by using Examples and Comparative Examples which do not limit the scope of the exemplary embodiment. Note that "parts" means "parts by mass" and "%" means "mass %" in the description below unless otherwise noted.

<Preparation of Toner (1)>

—Synthesis of Polyester Resin (1)—

Into a three-neck flask heated and dried, 100 mass % of a monomer component constituted by 100 mol % decanedicarboxylic acid and 100 molt nonanediol and 0.3 mass % of dibutyl tin oxide are placed. Inside the flask is vacuumed to replace air with nitrogen gas to create an inert atmosphere, and the mixture is stirred and refluxed at 180° C. for 5 hours under mechanical stirring.

The temperature is slowly increased to 230° C. under a reduced pressure. The mixture is stirred for 2 hours and air-cooled once entering a viscous state to terminate the reaction. As a result, a polyester resin (1) is obtained by polymerization.

The molecular weight (polystyrene equivalent) is measured by gel permeation chromatography. The weight-average molecular weight (Mw) of the polyester resin (1) is 23,300, the number-average molecular weight (Mn) is 7,300, and the melting point is 72.2° C.

—Synthesis of Polyester Resin Particle Dispersion (1)—

A resin particle dispersion having the following composition is prepared by using the obtained polyester resin.

Polyester resin (1): 90 parts

Ionic surfactant (NEOGEN RK produced by DAI-ICHI KOGYO SEIYAKU CO., LTD.): 1.8 parts Ion exchange water: 210 parts These components are heated to 100° C., dispersed with ULTRA-TURRAX T50 produced by IKA, and heated to 110° C. with a pressure discharge-type Gaulin homogenizer to conduct a dispersing process for 1 hour. As a result, a polyester resin particle dispersion (1) having a volume-average particle size of 230 nm and a solid content of 30 mass % is obtained.

—Synthesis of polyester resin (2)—

Bisphenol A-ethylene oxide 2-mol adduct: 30 mol %

Bisphenol A-propylene oxide adduct: 70 mol %

Terephthalic acid: 45 mol %

Fumaric acid: 40 mol %

Dodecenylsuccinic acid: 15 mol %

These components (monomers) are placed in a 5 L flask equipped with a stirrer, a nitrogen inlet tube, a temperature sensor, and a rectifier and heated to 190° C. over 1 hour. After confirming that the reaction system is being stirred, 0.8 parts of tin distearate is added to 100 parts of the components (feed monomers).

The temperature is raised to 240° C. from that temperature over 6 hours while distilling away water produced, and dehydration condensation reaction is continued at 240° C. for 3 more hours. As a result, a polyester resin (2) having a glass transition temperature of 57° C., an acid value of 14.6 mgKOH/g, a weight-average molecular weight of 20,000, and a number average-molecular weight of 6,500 is obtained.

—Synthesis of Polyester Resin Particle Dispersion (2)—

Polyester resin (2): 100 parts

Ethyl acetate: 50 parts

Isopropyl alcohol: 15 parts

Ethyl acetate is placed in a 5 L separable flask and then the polyester resin (2) is slowly added thereto. Stirring is performed with a three-one motor to completely dissolve the polyester resin and obtain an oil phase. To the oil phase under stirring, a 10 mass % aqueous ammonia solution is slowly added dropwise using a dropper so that the total amount of the aqueous solution is 3 parts. Thereto, 230 parts of ion exchange water is slowly added dropwise at a rate of 10 ml/min to conduct phase inversion emulsification. The solvent is removed while reducing the pressure with an evaporator. As a result, a polyester resin particle dispersion (2) containing non-crystalline polyester resin is obtained. The volume-average particle size of the resin particles dispersed in this dispersion is 150 nm. The resin particle concentration in the dispersion is adjusted to 30 mass % with ion exchange water.

—Synthesis of colorant dispersion (1) —

Cyan pigment (copper phthalocyanine B15:3 DAINICHISEIKA COLOR AND CHEMICALS MFG. CO., LTD.)): 50 parts Anionic surfactant(NEOGEN SC produced by DAI-KOGYO SEIYAKU CO., LTD.): 5 parts Ion exchange water: 200 parts These components are mixed and dispersed with a homogenizer (ULTRA-TURRAX produced by IKA) for 10 minutes, and dispersed under a pressure of 245 Mpa by using ULTIMAIZER (impact-type wet pulverizer produced by SUGINO MACHINE LIMITED) for 15 minutes. As a result, a colorant dispersion (1) having a colorant particle center size of 182 nm and a solid content of 20.0 mass % is obtained.

—Synthesis of releasing agent dispersion (1) —

Paraffin wax (HNP-9 NIPPON SEIRO CO., LTD.)): 20 parts

Anionic surfactant (NEOGEN SC produced by DAI-ICHI KOGYO SEIYAKU CO., LTD.): 1 part Ion exchange water : 80 parts These components are mixed in a heat-resistant container and heated to 90° C., followed by stirring for 30 minutes. Next, the melt is released from the bottom of the container and distributed to a Gaulin homogenizer. After conducting recirculation operation equivalent to 3 passes under a pressure of 5 MPa, the pressure is increased to 35 MPa and recirculation operation equivalent to 3 passes is further conducted. The resulting emulsion is cooled in the heat-resistant container to 40° C. or less. As a result, a releasing agent dispersion (1) having a center particle size of 182 nm and a solid content of 20.0 mass % is obtained.

—Preparation of Core Particles (1)—

Polyester resin particle dispersion (1): 50 parts

Polyester resin particle dispersion (2): 160 parts

Colorant particle dispersion (1): 30 parts

Releasing agent particle dispersion (1): 40 parts

These components are mixed and dispersed in a stainless steel round flask using ULTRA-TURRAX T50. To the mixture, 0.20 parts of polyaluminum chloride is added and dispersion is continued by using ULTRA-TURRAX. The flask is heated to 45° C. under stirring in a hot oil bath. After retained at 45° C. for 60 minutes, 60 parts of the polyester resin particle dispersion (2) is slowly added.

After pH of the solution in the flask is adjusted to 8.0 by using a 0.5 mol/L aqueous sodium hydroxide solution, the stainless steel flask is sealed, heated to 90° C. while continuing stirring by using magnetic seal, and retained thereat for 3 hours.

—Preparation of Toner Particles (1) (Formation of Coating Layers on Core Particles (1))—

Next, the temperature is decreased to 60° C., 2 parts of an anionic surfactant (DOWFAX produced by DOW CHEMICAL COMPANY) and 135 parts of ion exchange water are added to the flask, and the interior of the flask is purged with nitrogen to create a nitrogen atmosphere. After retained at 60° C. for 30 minutes, 2.4 parts of methyl methacrylate, 1 part of glycerin monomethacrylate (BLEMMER GLM produced by NOF CORPORATION), and 0.09 parts of ammonium persulfate are added to the flask, and the mixture is stirred for 3 hours. The temperature in the flask is cooled to room temperature, 1 part of trimethyl borate is added, and stirring is continued further for 30 minutes.

Upon completion of reaction, filtration and washing with ion exchange water are conducted, and solid-liquid separation is performed by Nutsche suction filtration. The resulting mixture is re-dispersed in 1 L of ion exchange water at 40° C. and stirred and washed for 15 minutes at 300 rpm.

The solid-liquid separation and re-dispersion are further repeated 5 times. When pH of the filtrate is 7.5 and an electrical conductivity is 7.0 μS/cmt, solid-liquid separation is performed using a No. 5A paper filter by Nutsche suction filtration.

Vacuum drying is continued for 12 hours. As a result, toner particles (1) having a core-shell structure in which a core particle (1) is coated with an acrylic resin, i.e., boron crosslinked resin, (coating layer), are obtained.

The infrared absorption spectrum of the toner particles (1) is measured. The absorption spectrum changes from 1380 $cm^{-1}$ to 1310 $cm^{-1}$ between before and after addition of trimethyl borate. This confirms formation of a boric acid ester link (boron crosslinked structure). In the examples of forming resins described below, formation of a boric acid ester link (boron crosslinked structure) is confirmed by the same analytic method.

The size of the toner particles (1) is measured. The volume-average particle size is 5.0 μm and the volume-average particle size distribution index GSDv is 1.20. The shape factor SF1 determined by shape observation with a LUZEX image processor is 132.

—External Addition to Toner Particles (1)—

Silica ($SiO_2$) particles having an average primary particle size of 40 nm, surfaces of which are hydrophobized with hexamethyldisilazane (also referred to as "HMDS" hereinafter), and metatitanic acid compound particles having an average primary particle size of 20 nm which are a reaction product between metatitanic acid and isobutyltrimethoxysilane are added to the obtained toner particles (1) so that the ratio (coverage) of the surfaces of the toner particles coated with these particles is 40%, i.e., 10 parts by mass of the silica particles and 10 parts by mass of the metatitanic acid compound particles are added to 100 parts by mass of the toner particles. The resulting mixture is mixed with a HENSCHEL mixer to prepare a toner (1).

<Preparation of toner (2)>

—Preparation of acrylic resin particle dispersion (3)—

Styrene: 325 parts by mass n-Butyl methacrylate: 75 parts by mass

β-Carboxyethyl acrylate: 9 parts by mass

1'10-Decanediol diacrylate (SHIN-NAKAMURA CHEMICAL CO., LTD.): 1.5 parts by mass Dodecanethiol (WAKO PURE CHEMICAL INDUSTRIES, LTD.): 2.7 parts by mass To a solution of the above-mentioned components in a 2 L flask, a solution prepared by dissolving 4 parts by mass of an anionic surfactant (DOWFAX produced by DOW CHEMICAL COMPANY) in 550 parts by mass of ion exchange water is added. The mixture is dispersed and emulsified in the flask. While slowly stirring and mixing the mixture for 10 minutes, 50 parts by mass of ion exchange water dissolving 6 parts by mass of ammonium persulfate is added thereto. After the interior of the flask is thoroughly purged with nitrogen, the solution in the flask is heated to 70° C. in an oil bath under stirring and emulsion polymerization is continued as is for 5 hours. As a result, an anionic acrylic resin particle dispersion (3) having a solid content of 42% is obtained.

The resin particles in the acrylic resin particle dispersion (3) have a center particle size of 196 nm and a weight-average molecular weight Mw or 32,400.

—Preparation of colorant dispersion (2)—

Cyan pigment (copper phthalocyanine B15:3 produced by DAINICHISEIKA COLOR AND CHEMICALS MFG. CO. LTD.): 45 parts Nonionic surfactant (NONIPOL 400 produced by SANYL CHEMICAL INDUSTRIES. LTD.): 5 parts by mass Ion exchange water : 200 parts by mass These components are mixed and dispersed with a homogenizer (ULTRA-TURRAX produced by IKA) for 10 minutes, and dispersed under a pressure of 245 Mpa by using ULTIMAIZER (impact-type wet pulverizer produced by SUGINO MACHINE LIMITED) for 15 minutes. As a result, a colorant dispersion (2) having a colorant particle center size of 162 nm and a solid content of 20.0 mass % is obtained.

—Preparation of releasing agent dispersion (2)—

12-Hydroxystearic acid triglyceride: 45 parts by mass (Product of KAWAKEN FINE CHEMICALS CO., LTD.: K-3 WAX-500, melting point: 86° C., SP value: 9.9)

Ionic surfactant, NEOGEN RK (produced by DAI-CHI KOGYO SEIYAKU CO., LTD.): 5 parts by mass ion exchange water : 200 parts by mass These components are heated to 120° C., thoroughly dispersed with ULTRA-TURRAX T50 produced by IKA, and dispersed with a pressure discharge-type Gaulin homogenizer. As a result, a releasing agent dispersion (2) including releasing agent particles having a center particle size of 220 nm and a solid content of 22.0 mass % is obtained.

—Preparation of releasing agent dispersion (3)—

Carnauba wax: 45 parts by mass (Product of TOAKASEI CO., LTD.: purified granular carnauba wax, melting point: 82° C., SP value: 8.3)

Ionic surfactant, NEOGEN RK (produced by DAI-CHI KOGYO SEIYAKU CO., LTD.): 5 parts by mass Ion exchange water: 200 parts by mass These components are heated to 120° C., thoroughly dispersed with ULTRA-TURRAX T50 produced by IKA, and dispersed with a pressure discharge-type Gaulin homogenizer. As a result, a releasing agent dispersion (3) including releasing agent particles having a center particle size of 230 nm and a solid content of 21.0 mass % is obtained.

—Preparation of Core Particles (2)—

Acrylic resin particle dispersion (3): 106 parts by mass

Colorant dispersion (2): 16 parts by mass

Releasing agent dispersion (2): 18 parts by mass

Releasing agent dispersion (3): 19 parts by mass

These components are mixed and dispersed in a stainless steel round flask using ULTRA-TURRAX T50. To the mixture, 0.4 parts by mass of polyaluminum chloride is added to form agglomerated particles and dispersion is continued by using ULTRA-TURRAX. The solution in the flask is heated to 49° C. using a hot oil bath under stirring and retained at 49° C. for 60 minutes. Thereto, 40 parts by mass of the acrylic resin particle dispersion (3) is slowly added. After pH of the solution is adjusted to 9.0 by using a 0.5 mol/L aqueous sodium hydroxide solution, the stainless steel flask is sealed, heated while continuing stirring by using magnetic seal to 96° C., and retained thereat for 5 hours.

—Preparation of Toner Particles (2) (Formation of Coating Layers on Core Particles (2))—

Next, the temperature is decreased to 60° C., 1.5 parts of an anionic surfactant (DOWFAX produced by DOW CHEMICAL COMPANY) and 138 parts of ion exchange water are added to the flask, and the interior of the flask is purged with nitrogen to create a nitrogen atmosphere. After retained at 60° C. for 30 minutes, 1.7 parts of methyl methacrylate, 0.7 part of glycerin monomethacrylate (BLEMMER GLM produced by NOF CORPORATION), and 0.06 parts of ammonium persulfate are added to the flask, and the mixture is stirred for 3 hours. The temperature in the flask is cooled to room temperature, 0.7 parts of trimethyl borate is added, and stirring is continued further for 30 minutes.

Upon completion of reaction, filtration and washing with ion exchange water are conducted, and solid-liquid separation is performed by Nutsche suction filtration. The resulting mixture is re-dispersed in 1 L of ion exchange water at 40° C. and stirred and washed for 15 minutes at 300 rpm.

The solid-liquid separation and re-dispersion are further repeated 5 times. When pH of the filtrate is 7.5 and an electrical conductivity is 7.0 μS/cmt, solid-liquid separation is performed using a No. 5A paper filter by Nutsche suction filtration. Vacuum drying is continued for 12 hours. As a result, toner particles (2) having a core-shell structure including core particles (2) coated with an acrylic resin (coating layer), i.e., boron crosslinked resin, are obtained.

The size of the toner particles (2) is measured. The volume-average particle size is 5.1 μm and the volume-average particle size distribution index GSDv is 1.20. The shape factor SF1 determined by shape observation with a LUZEX image processor is 130.

—External Addition to Toner Particles (2)—

Silica ($SiO_2$) particles having a primary particle average size of 40 nm, surfaces of which are hydrophobized with hexamethyldisilazane (also referred to as "HMDS" hereinafter), and metatitanic acid compound fine particles having a primary particle average size of 20 nm which are a reaction product between metatitanic acid and isobutyltrimethoxysilane are added to the obtained toner particles (2) so that the ratio (coverage) of the surfaces of the toner particles coated with these particles is 40%, i.e., 10 parts by mass of the silica particles and 10 parts by mass of the metatitanic acid compound particles are added to 100 parts by mass of the toner particles. The resulting mixture is mixed with a HENSCHEL mixer to prepare a toner (2).

<Preparation of toner (3)>

—Preparation of releasing agent dispersion (4)—

12-Hydroxystearic acid: 45 parts by mass (Product of KAWAKEN FINE CHEMICALS CO., LTD.: KOW, melting point: 72° C., SP value: 10.0)

Ionic surfactant, NEOGEN RK (produced by DAI-ICHI KOGYO SEIYAKU CO., LTD.): 5 parts by mass Ion exchange water: 200 parts by mass These components are heated to 120° C., thoroughly dispersed with ULTRA-TURRAX T50 produced by IRA, and dispersed with a pressure discharge-type Gaulin homogenizer. As a result, a releasing agent dispersion (4) including releasing agent particles having a center particle size of 210 nm and a solid content of 20.0 mass is obtained.

—Preparation of Core Particles (3)—

Core particles (3) are prepared as with the core particles (2) except that the releasing agent dispersion (4) is used instead of the releasing agent dispersion (2).

—Preparation of Toner Particles (3) (Formation of Coating Layers on Core Particles (3))—

Toner particles (3) are prepared as with the toner particles (2) except that the core particles (3) are used instead of the core particles (2).

The volume-average particle size of the obtained toner particles is 5.5 μm and the volume-average particle size distribution index GSDv is 1.22. The shape factor SF1 determined by shape observation with a LUZEX image processor is 136.

—External Addition to Toner Particles (3)—

A toner (3) is prepared as with the toner (2) except that the toner particles (3) are used instead of the toner particles (2).

<Preparation of Toner (4)>

—Preparation of Polyester Resin Particle Dispersion (4)—

To a mixed solution of 25 parts by mass of isopropyl alcohol and 25 parts by mass of ethyl acetate, 100 parts by mass of a polyester resin (Mw: 50,000, Mn: 3,000, acid value: 15 mgKOH/g, hydroxyl value: 27 mgKOH/g, Tg: 61° C.) synthesized from 45 parts by mass of bisphenol A-propylene oxide adduct, 5 parts by mass of bisphenol A-ethylene oxide adduct, 25 parts by mass of a terephthalic acid derivative, 15 parts by mass of trimellitic anhydride, and 15 parts by mass of fumaric acid is added. To the solution under stirring, 2 parts by mass of ammonia water diluted to 10% with ion exchange water is added dropwise and then 250 parts by mass of ion exchange water is slowly added to the mixture dropwise to conduct emulsification. The solvent is removed in a reduced pressure while continuing the stirring. As a result, a polyester resin particle dispersion (4) having a solid content of 26.5% is obtained.

The resin particles in the polyester resin particle dispersion (4) has a center particle size of 110 nm.

—Preparation of Polyester Resin Particle Dispersion (5)—

To a dried and heated three-neck flask, 85 mol % of dimethyl sebacate, 15 mol % n-octadecenyl succinic anhydride, ethylene glycol (1.5 mol relative to the acid component), and a catalyst $Ti(OBu)_4$ (0.012 wt % relative to the acid component) are added. The pressure inside the flask is reduced and an inert atmosphere is created with nitrogen gas. Then reflux is conducted at 180° C. for 6 hours under mechanical stirring. Excess ethylene glycol is removed by reduced-pressure distillation, the temperature of the mixture is slowly raised to 230° C., and the mixture is stirred for 4 hours. When the mixture becomes viscous, the molecular weight is determined by gel permeation chromatography (polystyrene equivalent). After the weight-average molecular weight reaches 70,000, the reduced-pressure distillation is stopped and the mixture is air-dried. As a result a crystalline polyester resin is obtained. Tg is not observed in the range of 0° C. or more, and the melting temperature is 74° C.

Into a stainless steel beaker, 80 parts by mass of the crystalline polyester resin and 720 parts by mass of deionized water are added. The beaker is placed in a hot bath and heated to 95° C. Once the crystalline polyester resin is melted, the mixture is stirred with a homogenizer (ULTRA-TURRAX T50 produced by IKA) at 8000 rpm. Then emulsion dispersion process is conducted while adding dropwise 20 parts by mass of an aqueous solution prepared by diluting 1.6 parts by mass of an anionic surfactant (NEOGEN RK produced by DAI-ICHI KOGYO SEIYAKU CO., LTD.). As a result, a resin particle dispersion (5) containing crystalline polyester resin having a volume-average particle size of 170 nm is prepared (resin particle concentration: 10 mass %).

—Preparation of Core Particles (4)—

Toner particles (4) are prepared as with the toner particles (2) except that 160 parts by mass of the polyester resin particle dispersion (4) and 100 parts by mass of the polyester resin particle dispersion (5) are used instead of the 106 parts of the initial feed of the acrylic resin particle dispersion (3) and that 40 parts by mass of the polyester resin particle dispersion (4) is used instead of 40 parts by mass of the acrylic resin particle dispersion (3) added subsequently.

—Preparation of Toner Particles (4) (Formation of Coating Layers on Core Particles (4))—

Toner particles (4) are prepared as with the toner particles (2) except that the core particles (4) are used instead of the core particles (2).

The volume-average particle size of the obtained toner particles is 5.2 μm and the volume-average particle size distribution index GSDv is 1.20. The shape factor SF1 determined by shape observation with a LUZEX image processor is 131.

—External Addition to Toner Particles (4)—

A toner (4) is prepared as with the toner (2) except that the toner particles (4) are used instead of the toner particles (2).

<Preparation of Toners (5) to (8)>

Toner particles (5) to (8) are prepared as with the toner particles (1) except that boric acid derivatives indicated in Table 1 in amounts indicated in Table 1 are used instead of 1 part of trimethyl borate in forming the coating layers. The volume-average size, average size distribution index, and shape factor SF1 of the obtained toner particles are also presented in Table 1.

Toners (5) to (8) are prepared as with the toner (1) except that the toner particles (5) to (8) are used instead of the toner particles (1).

TABLE 1

| | Boric acid derivative | | Particle size | | |
|---|---|---|---|---|---|
| | Type | Amount added (parts) | Volume-average particle size (μm) | Average particle size distribution index (GSDv) | Shape factor (SF1) |
| Toner (5) | Trimethyl borate | 0.08 | 5.0 | 1.20 | 132 |
| Toner (6) | Trimethyl borate | 0.06 | 5.0 | 1.20 | 132 |
| Toner (7) | Tri-n-butyl borate | 2 | 5.1 | 1.21 | 133 |
| Toner (8) | Tri-n-butyl borate | 4 | 5.2 | 1.22 | 134 |

<Preparation of Toners (9) to (13)>

Toner particles (9) to (13) are prepared as with the toner particles (1) except that monomers indicated in Table 2 are used in amounts indicated in Table 2 instead of 2.4 parts of methyl methacrylate and 1 part of glycerin monomethacrylate. The volume-average size, average size distribution index, and shape factor SF1 of the obtained toner particles are also presented in Table 2.

Toners (9) to (13) are prepared as with the toner (1) except that the toner particles (9) to (13) are used instead of the toner particles (1).

TABLE 2

| | Monomers (radically polymerizable monomers) | | Particle size: Volume-average particle size (μm) | Particle size: Average particle size distribution index (GSDv) | Shape factor (SF1) |
|---|---|---|---|---|---|
| Toner (9) | Ethyl methacrylate 2.4 parts | BLEMMER GLM 1 part | 5.1 | 1.21 | 133 |
| Toner (10) | Butyl methacrylate 2.4 parts | BLEMMER GLM 1 part | 2.0 | 1.20 | 132 |
| Toner (11) | Methyl methacrylate 2.4 parts | 2-Hydroxyethyl methacrylate 1 part | 5.1 | 1.21 | 133 |
| Toner (12) | Ethyl methacrylate 2.4 parts | 2-Hydroxyethyl methacrylate 1 part | 5.2 | 1.22 | 134 |
| Toner (13) | Butyl methacrylate 2.4 parts | 2-Hydroxyethyl methacrylate 1 part | 5.2 | 1.22 | 134 |

<Preparation of Toners (14) to (16)>

Toner particles (14) to (16) are prepared as with the toner particles (1) except that amounts of methyl methacrylate, glycerin monomethacrylate (BLEMMER GLM), and trimethyl borate added in forming the coating layers are changed as indicated in Table 3. The volume-average size, average size distribution index, and shape factor SF1 of the obtained toner particles are also presented in Table 3.

Toners (14) to (16) are prepared as with the toner (1) except that the toner particles (14) to (16) are used instead of the toner particles (1).

TABLE 3

| | Methyl methacrylate (parts) | BLEMMER GLM (parts) | Trimethyl borate (parts) | Particle size: Volume-average particle size (μm) | Particle size: Average particle size distribution index (GSDv) | Shape factor (SF1) |
|---|---|---|---|---|---|---|
| Toner (14) | 6 | 2.5 | 2.5 | 5.7 | 1.24 | 138 |
| Toner (15) | 1.7 | 0.7 | 0.7 | 4.9 | 1.19 | 129 |
| Toner (16) | 0.85 | 0.35 | 0.35 | 4.8 | 1.18 | 128 |

<Preparation of Toner (17)>

—Synthesis of Acrylic Resin (6)—

Styrene: 325 parts by mass n-Butyl methacrylate: 75 parts by mass

Methyl ethyl ketone: 960 parts by mass

These components are placed in a 3 L three-necked flask and the mixture is retained at 65° C. for 30 minutes in a nitrogen atmosphere. Then 4 g of 2,2'-azobis(2,4-dimethylvaleronitrile) WAKO PURE CHEMICAL INDUSTRIES, LTD.) is added to the mixture and the mixture is stirred at 65° C. Four hours later, the mixture is cooled to room temperature (25° C.), and polymerization products are placed in 5 L of water to precipitate the polymer. An acrylic resin (6) is obtained by drying the polymer. The weight-average molecular weight Mw is 25,000.

—Preparation of core particles (17)—

Acrylic resin (6): 160 parts

Cyan pigment (EB15:3 produced by DAINICHISEIKA COLOR & CHEMICALS MFG. CO., LTD.): 60 parts Polypropylene wax (Polywax 725 produced by TOYO PETROLITE): 8.6 parts These components are melted and mixed with a BANBURY mixer. The mixture is then cooled and roughly pulverized to a size of 1 mm or less. The mixture is further pulverized and classified. As a result, core particles (17) having a volume-average particle size of 6.5 μm are obtained.

—Preparation of toner particles (17) (formation of coating layers on core particles (17))—

Core particles (17): 90 parts

Ionic surfactant (NEOGEN RK produced by DAI-ICHI KOGYO SEIYAKU CO., LTD.): 1.8 parts Ion exchange water : 210 parts These components are heated to 100° C., dispersed with ULTRA-TURRAX T50 produced by IKA, and heated to 110° C. with a pressure discharge-type Gaulin homogenizer to conduct a dispersing process for 1 hour. As a result, a pulverized material dispersion having a volume-average particle size of 6.5 μm and a solid content of 30 mass % is obtained.

Next, 270 parts of the pulverized material dispersion, 2 parts of an anionic surfactant (DOWFAX produced by DOW CHEMICAL COMPANY), and 135 parts of ion exchange water are placed in a stainless steel round flask. The mixture is retained at 60° C. for 30 minutes in a nitrogen atmosphere.

Then 2.4 parts of methyl methacrylate, 1 part of BLEMMER GLM (produced by NOF CORPORATION), and 0.09 parts of ammonium persulfate are added to the flask, and the mixture is stirred for 3 hours. The temperature in the flask is cooled to room temperature, 1 part of trimethyl borate is added, and stirring is continued further for 30 minutes.

Upon completion of the reaction, filtration and washing with ion exchange water are conducted, and solid-liquid separation is performed by Nutsche suction filtration. The resulting mixture is re-dispersed in 1 L of ion exchange water at 40° C. and stirred and washed for 15 minutes at 300 rpm.

The solid-liquid separation and re-dispersion are repeated 5 times. When pH of the filtrate is 7.5 and an electrical conductivity is 7.0 μS/cmt, solid-liquid separation is performed using a No. 5A paper filter by Nutsche suction filtration. Vacuum drying is then continued for 12 hours. As a result toner particles (17) with shell layers are obtained.

The size of the toner particles (17) is measured. The volume-average particle size is 6.7 μm and the volume-average particle size distribution index GSDv is 1.25. The shape factor determined by shape observation with a LUZEX image processor is 135.

—External Addition to Toner Particles (17)—

Silica ($SiO_2$) particles having a primary particle average size of 40 nm, surfaces of which are hydrophobized with HMDS are added to the obtained toner particles (17) so that the ratio (coverage) of the surfaces of the toner particles coated with these particles is 40%, i.e., 10 parts by mass of the silica particles are added to 100 parts by mass of the toner particles. The resulting mixture is mixed with a HENSCHEL mixer to prepare a toner (17).

<Preparation of Toner (18)>

Toner particles (18) are prepared as with the toner particles (1) except that trimethyl borate is not used in forming the coating layers. The volume-average particle size of the obtained toner particles is 5.0 μm and the volume-average particle size distribution index GSDv is 1.22. The shape factor SF1 is 136.

A toner (18) is prepared as with the toner (1) except that the toner particles (18) are used instead of the toner particles (1).

<Preparation of Toner (19)>

Toner particles (19) are prepared as with the toner particles (2) except that trimethyl borate is not used in forming the coating layers. The volume-average particle size of the obtained toner particles is 5.0 μm and the volume-average particle size distribution index GSDv is 1.22. The shape factor SF1 is 136.

A toner (19) is prepared as with the toner (2) except that the toner particles (19) are used instead of the toner particles (2).

<Preparation of Carrier (1)>

A carbon black dispersion is prepared by stirring and dispersing a mixture of 1.25 parts of toluene and 0.12 parts of carbon black (trade name: VXC-72 produced by CABOT CORPORATION) in a sand mill for 20 minutes. A coater resin solution is prepared by mixing the carbon dispersion and 1.25 parts of a trifuntional isocyanate 80% Ethylacetate solution (TAKANATE D110N produced by TAKEDA PHARMACEUTICAL COMPANY LIMITED). The coater resin solution and Mn-Mg-ferrite particles (volume average particle size: 35 μm) are placed in a kneader. The mixture is mixed for 5 minutes at room temperature under stirring and heated to 150° C. at normal pressure to remove the solvent. After further conducting mixing for 30 minutes under stirring, the heater is turned off and the temperature is decreased to 50° C. The resulting coat carrier is sieved through a 75 μm mesh to prepare a carrier (1).

<Preparation of Carrier (2)>

A carbon black dispersion is prepared by mixing 14 parts of toluene, 0.2 parts of carbon black (trade name: R330 produced by CABOT CORPORATION), and styrene-methyl methacrylate copolymer (component weight ratio: 90/10) and dispersing the mixture under stirring in a sand mill for 20 minutes. The carbon dispersion and 100 parts of ferrite particles (average size: 50 μm) are placed in a vacuum deairing kneader and stirred for 30 minutes at 60° C. Subsequently, the pressure is reduced under heating to remove air and the solvent. After further conducting mixing for 30 minutes under stirring, the heater is turned off and the temperature is decreased to 50° C. The resulting coat carrier is sieved through a 75 μm mesh to prepare a carrier (2).

Example 1

A developer (1) is prepared by stirring 8 parts of the toner (1) and 92 parts of the carrier (1) in a V-blender at 40 rpm for 20 minutes and sieving the mixture though a 177 μm sieve.

Example 2

A developer (2) is prepared by stirring 5 parts of the toner (2) and 100 parts of the carrier (2) in a V-blender at 40 rpm for 20 minutes and sieving the mixture though a 177 μm sieve.

Examples 3 to 17

Developers (3) to (17) are prepared as with the developer (1) except that the toners (3) to (17) are used instead of the toner (1).

Comparative Examples 1 and 2

Developers (18) and (19) are prepared as with the developer (1) except that the toners (18) to (19) are used instead of the toner (1).

<Evaluation of the Toner Storage Property>

In an atmosphere having a temperature of 45° C. and a humidity of 50%, 2 g of the toner obtained (toners (1) to (19)) is left standing for 48 hours. Then the toner is placed on a mesh having 75 μm apertures and the undersieve is suctioned from the rear side of the mesh. The amount of the toner remaining on the mesh (blocking agglomeration amount) is measured and the toner storage property is evaluated. The results are shown in Table 4.

<Evaluation of the Toner Fixability>

Each developer (developers (1) to (19)) obtained is used in a commercial electrophotographic copier (A-Color 635 produced by FUJI XEROX CO., LTD.) to form an image by adjusting the applied toner amount to 4.5 g/$m^2$ and to thereby obtain an unfixed image.

A belt nip-system external fixing machine is used to increase the fixing temperature from 80° C. to 220° C. stepwise (by 5° C.) to determine the minimum fixing temperature and hot off-set temperature of the image. The results are shown in Table 4.

The minimum fixing temperature is determined by fixing an unfixed solid image (25 mm×25 mm), bending the fixed solid image by using a weight (1 kg), and unfolding the bent image. The fixing temperature at which the width of a portion from which the image is lost in the unfolded image is 1 mm or less is defined to be the minimum fixing temperature.

The hot off-set temperature is defined to the lowest temperature at which the contamination of a blank portion of the sheet is confirmed with naked eye after one turn of the fixing member (belt) surface after the fixing. In other words, this contamination is the contamination caused by re-transfer of the toner on the surface of the fixing member onto a blank paper after the toner is transferred onto the fixing member surface during fixing of the solid image and the fixing member is turned once.

TABLE 4

| | | Evaluation of toner storage property | | Evaluation of fixing | | |
|---|---|---|---|---|---|---|
| | | Amount remaining (g) | Rating | Minimum fixing temperature (° C.) | Hot offset (° C.) | Rating |
| Example 1 | Toner 1 | 0.05 | A | 120 | 200 | A |
| Example 2 | Toner 2 | 0.04 | A | 115 | 190 | A |
| Example 3 | Toner 3 | 0.04 | A | 115 | 200 | A |
| Example 4 | Toner 4 | 0.03 | A | 120 | 200 | A |
| Example 5 | Toner 5 | 0.07 | A | 120 | 200 | A |
| Example 6 | Toner 6 | 0.09 | A | 110 | 190 | A |
| Example 7 | Toner 7 | 0.05 | A | 120 | 200 | A |
| Example 8 | Toner 8 | 0.04 | A | 120 | 200 | A |
| Example 9 | Toner 9 | 0.04 | A | 115 | 200 | A |
| Example 10 | Toner 10 | 0.03 | A | 110 | 190 | A |
| Example 11 | Toner 11 | 0.04 | A | 120 | 200 | A |
| Example 12 | Toner 12 | 0.04 | A | 115 | 200 | A |
| Example 13 | Toner 13 | 0.03 | A | 110 | 190 | A |
| Example 14 | Toner 14 | 0.02 | A | 125 | 200 | A |
| Example 15 | Toner 15 | 0.11 | A | 120 | 200 | A |
| Example 16 | Toner 16 | 0.5 | B | 110 | 190 | A |
| Example 17 | Toner 17 | 0.04 | A | 115 | 190 | A |
| Comparative Example 1 | Toner 18 | 1.2 | C | 120 | 200 | A |
| Comparative Example 2 | Toner 19 | 1.2 | C | 120 | 200 | A |

<Determination of Charge Amount>

The developer is installed in a modified model of DOCUCOLOR 1250 produced by FUJI XEROX CO., LTD. The machine is left in a high-temperature, high-humidity environment (30° C., 90% RH) for 24 hours and then in a low-temperature, low-humidity environment (10° C., 20% RH) for 24 hours. Then 10,000 copies are made. Subsequently, only the developing device is rotated for 1 minute to stir the developer and 0.5 g of the developer on a magnetic sleeve is sampled. The powder charge amount analyzer (TB-200 produced by TOSHIBA CHEMICAL) is used to measure the charge amount under the following conditions. The results are shown in Table 5.

—Conditions—

A 20 μm-opening stainless steel metal net is installed in a Faraday cage to prevent the ferrite powder from leaking.

Blow pressure of the analyzer: 10 kPa in a terms of digital presentation

Suction pressure of the analyzer: 5 kPa

Time of blowing: 20 seconds

Measurement atmosphere: 25° C., 55% RH

<Evaluation of Developing Property>

The developer is installed in a modified model of DOCUCOLOR 1250 produced by FUJI XEROX CO., LTD. The machine is left in a high-temperature, high-humidity environment (30° C., 90% RH) for 24 hours and then in a low-temperature, low-humidity environment (10° C., 20% RH) for 24 hours. Then 10,000 copies are made.

An image having two 2 cm×5 cm patches (applied toner amount is set to 5.0 g/m$^2$) is printed. The developing amount upon hardware stop (i.e., the amount of development at the time when the operation of an image forming apparatus is stopped before a toner image formed on a photoconductor is transferred) is measured in each atmosphere. To be more specific, the two developed portions of the photoconductor are transferred by using the adhesiveness of an adhesive tape, the weight of the adhesive tape with the toner is measured, and the weight of the tape is subtracted from the observed weight. The average determined from the observed values is assumed to be the developing amount. The results are shown in Table 5.

As for the evaluation of fogging, a background portion (non-image portion) of the photoconductor is transferred onto an adhesive tape in the same manner, and the number of toner particles per square centimeter is counted. The rating A is given when the number is less than 100, B is given when the number is 100 to 500, and C is given when the number is greater than 500. The results are shown in Table 5.

<Evaluation of Transfer Property>

The developer is installed in a modified model of DOCUCOLOR 1250 produced by FUJI XEROX CO., LTD. The machine is left in a high-temperature, high-humidity environment (30° C., 90% RH) for 24 hours and then in a low-temperature, low-humidity environment (10° C., 20% RH) for 24 hours. Then 10,000 copies are made. Hardware-stop (stopping the operation of the image forming apparatus) is called upon completion of the transfer step in each atmosphere, and the toner on the two portions of the intermediate transfer member is transferred onto an adhesive tape as in the evaluation of the developing property. The weight of the tape with the toner is determined and the observed values are averaged after subtraction of the weight of the tape therefrom to determine the transferred toner amount a. The amount b of the toner remaining on the photoconductor is determined by the same manner, and the transfer efficiency is determined from the following equation. The evaluation standard is as below. The results are shown in Table 5.

$$\text{Transfer efficiency } \eta(\%)=a\times 100/(a+b)$$

—Evaluation Standard—

$\eta \geq 99\%$ . . . A $90\% \leq \eta < 99\%$ . . . B $\eta < 90\%$ . . . C

TABLE 5

| | Charge amount (μC/g) | | Developing properties: Developed amount ($g/m^2$) | | | | Developing properties: Fogging (particles) | | | | Transfer efficiency (%) | | | |
|---|---|---|---|---|---|---|---|---|---|---|---|---|---|---|
| | 30° C., 90% RH | 10° C., 20% RH | 30° C., 90% RH | | 10° C., 20% RH | | 30° C., 90% RH | | 10° C., 20% RH | | 30° C., 90% RH | | 10° C., 20% RH | |
| Ex. 1 | 36 | 44 | 4.6 | A | 4.3 | A | 75 | A | 35 | A | 99.3 | A | 99.7 | A |
| Ex. 2 | 37 | 45 | 4.6 | A | 4.4 | A | 75 | A | 30 | A | 99.5 | A | 99.8 | A |
| Ex. 3 | 36 | 44 | 4.6 | A | 4.3 | A | 75 | A | 35 | A | 99.3 | A | 99.7 | A |
| Ex. 4 | 37 | 44 | 4.6 | A | 4.3 | A | 65 | A | 30 | A | 99.3 | A | 99.7 | A |
| Ex. 5 | 33 | 40 | 4.0 | A | 4.2 | A | 150 | A | 70 | A | 99.0 | A | 99.4 | A |
| Ex. 6 | 31 | 37 | 3.9 | B | 4.2 | A | 250 | B | 150 | B | 95.0 | B | 99.2 | A |
| Ex. 7 | 36 | 44 | 4.6 | A | 4.3 | A | 75 | A | 35 | A | 99.3 | A | 99.7 | A |
| Ex. 8 | 36 | 44 | 4.6 | A | 4.3 | A | 75 | A | 35 | A | 99.3 | A | 99.7 | A |
| Ex. 9 | 37 | 45 | 4.6 | A | 4.4 | A | 75 | A | 30 | A | 99.5 | A | 99.8 | A |
| Ex. 10 | 37 | 45 | 4.6 | A | 4.4 | A | 75 | A | 30 | A | 99.5 | A | 99.8 | A |
| Ex. 11 | 34 | 41 | 4.1 | A | 4.3 | A | 125 | B | 60 | A | 99.2 | A | 99.5 | A |
| Ex. 12 | 34 | 41 | 4.1 | A | 4.3 | A | 125 | B | 60 | A | 99.2 | A | 99.5 | A |
| Ex. 13 | 33 | 40 | 4.0 | A | 4.2 | A | 150 | A | 70 | A | 99.0 | A | 99.4 | A |
| Ex. 14 | 40 | 45 | 4.8 | A | 4.3 | A | 60 | A | 20 | A | 99.8 | A | 99.9 | A |
| Ex. 15 | 33 | 40 | 4.0 | A | 4.2 | A | 150 | A | 70 | A | 99.0 | A | 99.4 | A |
| Ex. 16 | 30 | 35 | 3.8 | B | 4.2 | A | 400 | B | 300 | B | 93.0 | B | 99.0 | A |
| Ex. 17 | 37 | 45 | 4.6 | A | 4.4 | A | 75 | A | 30 | A | 99.5 | A | 99.8 | A |
| C.E. 1 | 26 | 33 | 2.9 | C | 3.5 | B | 510 | C | 450 | B | 88.3 | C | 92.0 | B |
| C.E. 2 | 26 | 33 | 2.9 | C | 3.5 | B | 510 | C | 450 | B | 88.3 | C | 92.0 | B |

Ex: Example, C.E.: Comparative Example

<Evaluation of Fogging Caused by Increase in Toner Amount>

The developer is installed in a modified model of DOCUCOLOR 1250 produced by FUJI XEROX CO., LTD. After 10,000 copies are made in a high-temperature high-humidity (30° C., 90% RH) atmosphere, the machine is placed in a low-temperature low-humidity (10° C., 20% RH) atmosphere. Five minutes later, development is conducted to form a 2 cm×5 cm toner image with an applied toner amount of 5.0 $g/m^2$ on the photoconductor. Before the toner image is transferred, operation of the image forming apparatus is stopped and the evaluation of fogging is conducted as with the evaluation of the developing property.

The results are shown in Table 6.

The image forming apparatus is set so that the toner amount in the developing device in a 10° C., 20% RH atmosphere is larger than the toner amount in the developing device in a 30° C., 90% RH atmosphere by 15%.

TABLE 6

| | Fogging (particles) | |
|---|---|---|
| Example 1 | 55 | A |
| Example 2 | 50 | A |
| Example 3 | 55 | A |
| Example 4 | 90 | A |
| Example 5 | 170 | B |
| Example 6 | 55 | A |
| Example 7 | 55 | A |
| Example 8 | 50 | A |
| Example 9 | 50 | A |
| Example 10 | 50 | A |
| Example 11 | 80 | A |
| Example 12 | 80 | A |
| Example 13 | 90 | A |
| Example 14 | 40 | A |
| Example 15 | 90 | A |
| Example 16 | 320 | B |
| Example 17 | 50 | A |
| Comparative Example 1 | 530 | C |
| Comparative Example 2 | 530 | C |

As shown in the table, fogging caused by the increase in toner amount in the developing device is suppressed in Examples compared to Comparative Examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic image developing toner comprising:

a core particle containing a binder resin; and a coating layer on the core particle, wherein the coating layer contains a resin having a crosslinked structure formed by using at least one of boric acid, organic boric acid, boric acid salts, and boric acid esters, and the resin having the crosslinked structure is obtained by polymerizing monomers in the presence of the core particle.

2. The electrostatic image developing toner according to claim 1, wherein the monomers include a monomer having a hydroxyl group.

3. The electrostatic image developing toner according to claim 1, wherein the core particle is formed by:

preparing a dispersion in which first particles containing the binder resin are dispersed in an aqueous medium;

agglomerating the first particles to form agglomerated particles containing the first particles; and heating the agglomerated particles to coalesce the agglomerated particles.

4. An electrostatic image developer comprising:

the electrostatic image developing toner according to claim 1; and a carrier.

5. A process cartridge comprising:

a developing unit that houses the electrostatic image developer according to claim 4.

6. A toner cartridge comprising:

the electrostatic image developing toner according to claim 1, wherein about 70% to about 95% of a volume of an interior of the toner cartridge is filled with the electrostatic image developing toner.

7. An electrostatic image developing toner comprising:

a core particle containing a binder resin; and a coating layer on the core particle, wherein the coating layer contains an acrylic resin having a crosslinked structure formed by boric acid, organic boric acid, boric acid salts, or boric acid esters.

8. The electrostatic image developing toner according to claim 7, wherein the acrylic resin is formed by polymerizing an acryl monomer having a hydroxyl group.

9. The electrostatic image developing toner according to claim 7, wherein the core particle is formed by:

preparing a dispersion in which first particles containing the binder resin are dispersed in an aqueous medium;

agglomerating the first particles to form agglomerated particles containing the first particles; and heating the agglomerated particles to coalesce the agglomerated particles.

10. An electrostatic image developer comprising:

the electrostatic image developing toner according to claim 7; and a carrier.

11. A toner cartridge comprising:

the electrostatic image developing toner according to claim 7, wherein about 70% to about 95% of a volume of an interior of the toner cartridge is filled with the electrostatic image developing toner.

* * * * *